US006452579B1

(12) United States Patent
Itoh et al.

(10) Patent No.: US 6,452,579 B1
(45) Date of Patent: Sep. 17, 2002

(54) DISPLAY APPARATUS

(75) Inventors: Goh Itoh, Yokohama; Hisao Fujiwara, Ageo; Hitoshi Kobayashi, Yokohama; Haruhiko Okumura, Fujisawa; Noboru Yamaguchi, Yashio; Toshiaki Watanabe; Yoshihiro Kikuchi, both of Yokohama; Takashi Ida, Kawasaki; Takeshi Chujoh, Tokyo; Yoko Sambonsugi, Yamato; Takeshi Nagai, Kawasaki; Rieko Furukawa, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/537,112

(22) Filed: Mar. 29, 2000

(30) Foreign Application Priority Data

Mar. 30, 1999 (JP) ..... 11-089327

(51) Int. Cl.[7] ..... G09G 3/36

(52) U.S. Cl. ..... 345/100; 345/92; 345/98; 345/99

(58) Field of Search ..... 345/92, 98, 99, 345/100, 555, 214

(56) References Cited

U.S. PATENT DOCUMENTS 5,481,274 A * 1/1996 Aratani et al. ..... 345/97
5,644,332 A * 7/1997 Matsuzaki et al. ..... 345/100
5,677,706 A * 10/1997 Inoue et al. ..... 345/100
5,736,981 A * 4/1998 Nobutani et al. ..... 345/536
5,844,535 A 12/1998 Itoh et al.
5,926,159 A * 7/1999 Matsuzaki et al. ..... 345/556
5,945,972 A * 8/1999 Okumura et al. ..... 345/103
6,091,889 A * 7/2000 Hwu et al. ..... 118/500
6,140,996 A * 10/2000 Nobutani et al. ..... 345/157

FOREIGN PATENT DOCUMENTS

JP 10-222133 8/1998

* cited by examiner

*Primary Examiner*—Richard Hjerpe
*Assistant Examiner*—Duc Q Dinh
(74) *Attorney, Agent, or Firm*—Finnegan, Henderson, Farabow, Garrett, & Dunner, L.L.P.

(57) ABSTRACT

A liquid crystal display apparatus comprising a display panel having a plurality of pixels arranged in a matrix, signals lines for inputting a video signal to the plurality of pixels, and switching elements for selecting the pixels individually, a video decoder which decodes input compressed video data to obtain a reconstructed picture signal for each frame, a change region detector for detecting a change region between a previous frame and a current frame by using the reconstructed picture signal, to obtain address data on the change region, a display signal converter for converting the reconstructed picture signal into a display picture signal, a difference signal detector for detecting a difference signal indicating at least a difference between the previous frame and the current frame, a switch driver for selectively driving the switching elements to select the pixels corresponding to the change region in accordance with the address data, and a signal line driver for adding the difference signal and the display picture signal of the previous frame, and inputting an addition result to the signal lines.

27 Claims, 14 Drawing Sheets

DISPLAY APPARATUS

CROSS-REFERENCE TO RELATED APPLICATIONS

This application is based upon and claims the benefit of priority from the prior Japanese Patent Application No. 11-089327, filed Mar. 30, 1999, the entire contents of which are incorporated herein by reference.

BACKGROUND OF THE INVENTION

The present invention relates to a display apparatus capable of improving picture quality at the time of displaying MPEG-4 pictures.

The present invention relates to a system for adaptively switching a drive method according to a specific position on a display panel and to a display apparatus optimal to display MPEG-4 pictures.

An active matrix type display apparatus, i.e., a liquid crystal display (LCD) apparatus stands an important position as a key device for a personal computer or a television monitor. It is also expected that the active matrix type display apparatus will become increasingly significant in the future display field due to its characteristic space saving, power saving and light weight.

Initially, the LCD apparatus was faced with various problems to be cleared up as a color display. Thanks to technological innovation and devoted exertions, these problems have been solved gradually one by one. Nevertheless, there is still a demand for further enhancing the performance of the LCD apparatus.

Approaches to further improve the LCD apparatus span several technical fields. One is an approach to deal with the afterimage phenomenon of the LCD apparatus. The other approach is to satisfy the requirements of technological innovation to follow up the trend of new technology in video media systems.

The video media systems include, for example, an MPEG (Motion Picture Experts Group) system targeting at digital broadcasting, DVD and the like. An MPEG-4 (Motion Picture Experts Group Phase 4) system has, in particular, successfully realized an LCD apparatus which saves power and reduces cost.

Now, the MPEG system will be described. First, the conventional case relating to the afterimage correction of the LCD and the reduction of the number of display bits will be described. Thereafter, a video picture encoding method, to which the present invention is applied as will be described later, will be outlined, while taking an MPEG-4 (Motion Picture Experts Group Phase 4) system which is one of the international standards for video picture encoding as an example.

First, the conventional technique relating to the afterimage correction will be described.

In a liquid crystal display (LCD) apparatus, when a state in which an electric field is applied to the liquid crystal is changed to a state in which an electric field is not applied thereto or when a state in which an electric field is not applied to the liquid crystal is changed to a state in which an electric field is applied thereto, the orientation direction of liquid crystal molecules changes. However, because of the response characteristics of the liquid crystal molecules, i.e., the characteristic of the rise or fall of change thereof, a state exhibiting desired optical characteristic cannot be sometimes obtained. This is visually recognized as an afterimage, which may possibly cause the deterioration of picture quality.

It is, therefore, necessary to cancel this afterimage phenomenon. To do so, there are proposed configurations in which an LCD apparatus is provided with an additional section to cancel the afterimage phenomenon. Those configurations include, for example, that shown in a technique disclosed by Japanese Patent Unexamined Application Publication No. 3-98086. The problem with the provision of this additional section is, however, to disadvantageously enlarge overall circuit size.

In a conventional LCD apparatus, if a video picture is displayed, pixel display contents are rewritten in units of pixels on the picture plane of a frame or a field according to picture signals supplied in units of frames or fields, thereby displaying the video picture on the image plane. That is, irrespectively of whether or not there is a change in the pictures between frames or fields, picture signals are re-input to all pixels. Owing to this, a write operation never fails to be carried out even to the pixels which do not have any picture change and do not need to be written.

In case of, for example, a configuration of 400×480 dots (=192,000 dots), since color display requires three types of colors R (red), G (green) an B (blue), the number of pixels constituting a picture plane amounts to 192,000×3 (R, G and B)=576,000 dots. In case of a configuration of 600×800 dots (=480,000 dots), the number of pixels constituting a picture plane amounts to 480,000×3 (R, G and B)=1,440,000 dots. Since the LCD comprises two or three driving transistors for each dot of R, G and B, the 576,000-dot configuration is required to drive at least 1,150,000 transistors, and the 1,440,000-dot configuration is required to drive at least 2,880,000 transistors.

Considering that such a huge number of transistors are driven once per frame (30 frames per second in case of the television system), power consumption for each write operation may be substantial. Meanwhile, if video pictures adopt the MPEG-4 encoding system, it is possible to provide a background region and an object region separately. Namely, in that case, it is not necessary to rewrite all of the pixels on a frame. If rewriting only the picture in a change region by using address information on the change region and difference information on the picture, the video pictures can be displayed.

While paying attention to this fact, if an LCD reconstructed picture is one according to the MPEG-4 video compression encoding system, the LCD apparatus is scanned not by a television scanning method for rewriting all the pixels of a frame but by a driving method which can rewrite only the pixels in the change region on a frame. With use of this driving method, the picture signal transfer amount of the MPEG-4 video picture compression method can be reduced. Further, even for the LCD apparatus, it is possible to pave the way for the lower power consumption of the LCD by utilizing the picture signal transfer amount reduction effect.

The MPEG-4 is, in particular, aimed to be utilized for the transmission of video pictures by employing an existing communication line having not so fast transmission rate, multimedia communication by means of mobile computer terminals or the like, videophones and the like. In case of a mobile terminal (portable terminal), in particular, power supply relies on batteries. Thus, it is and it will be a very significant challenge to save the power of the LCD apparatus which has a large effect on power saving among the constituent elements of the portable terminal.

BRIEF SUMMARY OF THE INVENTION

It is, therefore, an object of the present invention to provide a display apparatus capable of reducing LCD driving power without deteriorating display quality at the time of displaying encoded video data.

According to the invention, there is provided an active matrix type display apparatus comprising: an active matrix type display panel having a plurality of pixels arranged in a matrix, signals lines for inputting a video signal to the plurality of pixels, and switching elements configured to select the plurality of pixels individually; a video decoder configured to decode an input compressed video data, and obtain a reconstructed picture signal for each picture; a change region detector configured to detect a change region between a previous picture and a current picture by using the reconstructed picture signal obtained by the video decoder, and obtain address data on the change region; a display signal converter configured to input the reconstructed picture signal, and convert the reconstructed picture signal into a display picture signal; a difference signal detector configured to input a display picture signal of the previous picture and a display picture of the current picture, and detect a difference signal indicating at least a difference between the previous picture and the current picture; a switch driver configured to selectively drive the switching elements and select the pixels corresponding to the change region in accordance with the address data obtained by the change region detector; and a signal line driver configured to add the difference signal obtained by the difference signal detector and the display picture signal of the previous picture, and input an addition result to the signal lines.

According to the invention, there is provided an active matrix type display apparatus comprising: an active matrix type display panel having a plurality of pixels arranged in a matrix, signals lines for inputting a video signal to the plurality of pixels, and switching elements configured to select the plurality of pixels individually; a video decoder configured to decode an input compressed video data and obtain a reconstructed picture signal for each picture; a change region detector configured to detect a change region between a previous picture and a current picture by using the reconstructed picture signal obtained by the video decoder, and obtain address data on the change region; a display signal converter configured to input a reconstructed picture signal of the previous picture and a reconstructed picture signal of the current picture signal, and convert the reconstructed picture signals into display pixel signals having different amounts of display data between the pixels belonging to the change region and the pixels which do not belong to the change region, respectively; a difference signal detector configured to input a display picture signal of the previous picture and a display picture of the current picture, and detect a difference signal indicating at least a difference between the previous picture and the current picture; a switch driver configured to selectively drive the switching elements and select the pixels corresponding to the change region in accordance with the address data obtained by the change region detector; and a signal line driver configured to add the difference signal obtained by the difference signal detector and the display picture signal of the previous picture, and input an addition result to the signal lines.

According to the invention, there is provided a liquid crystal display apparatus comprising: a liquid crystal panel having a plurality of pixels arranged in a matrix, signals lines for inputting a video signal to the plurality of pixels, and switching elements configured to select the plurality of pixels individually; a video decoder configured to decode an input compressed video data and obtain a reconstructed picture signal for each frame; a change region detector configured to detect a change region between a previous frame and a current frame by using the reconstructed picture signal obtained by the video decoder, and obtain address data on the change region; a display signal converter configured to input a reconstructed picture signal of the previous frame and a reconstructed picture signal of the current frame, and convert the reconstructed picture signals into display picture signals, respectively; a switch driver configured to selectively drive the switching elements in accordance with an address signal obtained by the change region detector; and a signal line driver configured to add the difference signal obtained by the difference signal detector and the display picture signal of the previous frame, obtain a display picture signal having display bits for the pixels belonging to the change region of the current frame set fewer than display bits for the pixels belonging to other regions, and input the display picture signal to the signal lines.

With this configuration, a video signal corresponding to a region having a difference between the reconstructed picture signal of the previous frame and that of the current frame is supplied to the crystal display panel. As a result, the picture is displayed on the crystal display panel by rewriting only the picture in the difference region or the picture in the difference region is displayed by lowering the resolution.

Therefore, the picture is rewritten only for the change region, thereby making it possible to rewrite the change region in a one-frame time and to provide a display apparatus capable of reducing LCD driving power without deteriorating display quality.

Attention is particularly paid to rewriting a picture. In a conventional liquid crystal display apparatus, irrespectively of whether or not there is a change in the pictures between frames or fields, picture signals are re-input for all pixels. Owing to this, power consumption is increased by a write operation for the pixels which do not have any picture change and do not need to be written. According to the present invention, write operation is carried out for the pixels of the changed region and not for those of the unchanged region, whereby power consumption can be reduced.

According to the present invention, the number of display bits for pixels or groups of a plurality of pixels belonging to the change region of the current frame is set lower than that of display bits for the pixels or groups of a plurality of pixels which do not belong the change region.

As for the change region or particularly the continuously change region of a picture, it is difficult for human eyes to perceive the resolution of the region due to the human biological properties. Utilizing this, the picture in a moving region is displayed with fewer display bits to lower the resolution. If the number of display bits is decreased, time required for data transmission can be shortened accordingly. Besides, the picture is rewritten only for the change region. Thus, it is possible to rewrite the picture for the change region within a one-frame time and there is less fear of deteriorating apparent display quality. Further, if the resolution is lowered (i.e., the number of display bits is decreased), the driving power of the driver can be reduced, whereby picture quality can be maintained and a display apparatus capable of reducing LCD driving power.

In a conventional display apparatus, irrespectively of whether or not there is a change in the pictures between frames or fields, picture signals are re-input for all pixels. Owing to this, power consumption is increased by a write operation for the pixels which do not have any picture change and do not need to be written. According to the present invention, write operation is carried out in units of pixels, whereby power consumption can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
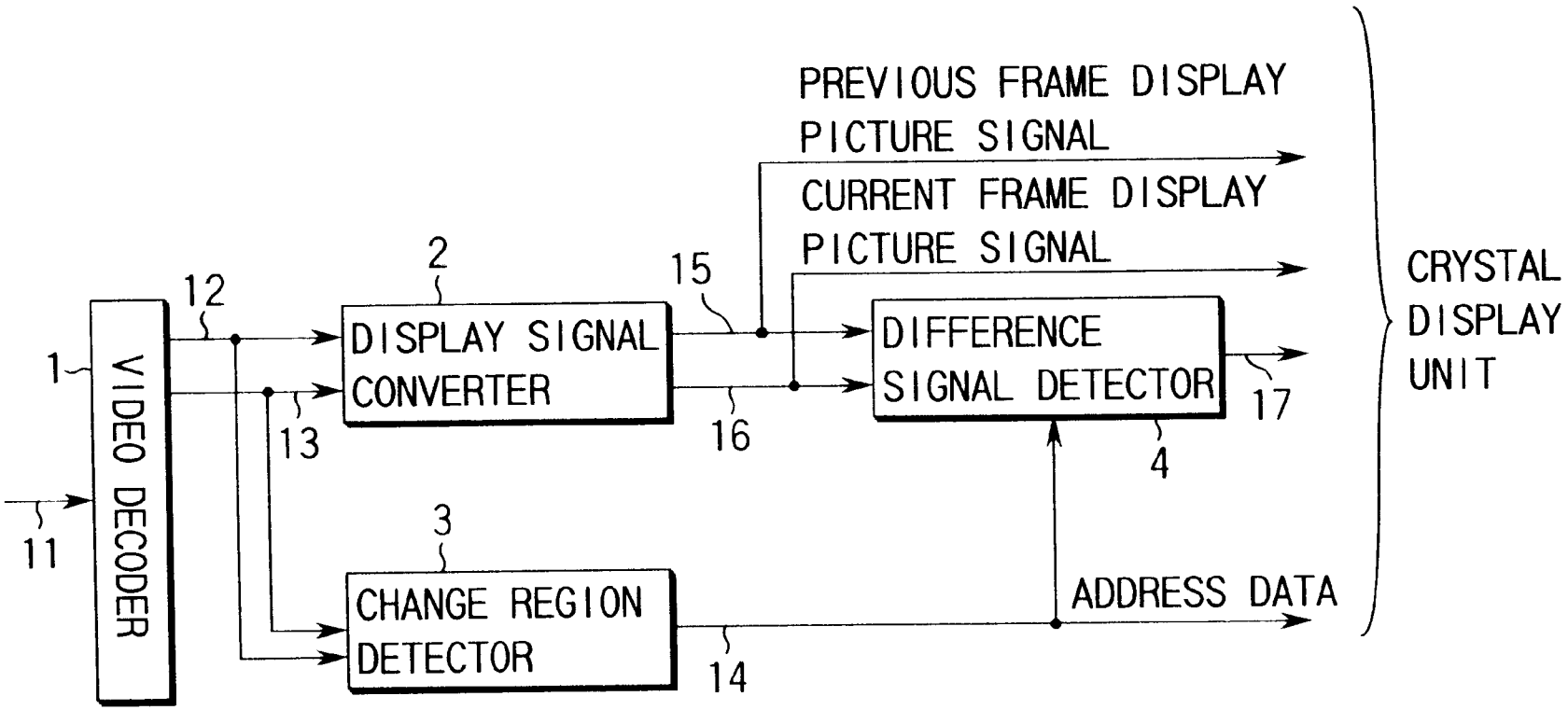
FIG. 1 is a block diagram showing the configuration of a video decoding apparatus in a first embodiment according to the present invention.

The embodiments of the present invention will be described hereinafter with reference to the accompanying drawings.

First, a picture is rewritten in units of pixels on lines containing a change region or unit blocks containing the change region among a picture in units of blocks. A picture signal is basically not supplied to an unchanged line or an unchanged unit block and the state of a previous picture is maintained thereon. This makes it possible to minimize rewrite operation, to minimize display driving for a crystal panel and to save power.

First, a liquid crystal display or LCD apparatus in the first embodiment will be described with reference to FIG. 1.

The LCD apparatus comprises a video decoder 1, a display signal converter 2, a change region detector section 3 and a difference signal detector section 4.

The video decoder 1 decodes input video encoded data 11. The change region detector section 3 obtains the difference between the decoded picture 12 of "a previous picture", e.g., "a previous frame" and the decoded picture 13 of "a current picture", e.g., "a current frame" among pictures (frames or fields) decoded by the video decoder 1, detects a region having the difference as a change region and outputs address information 14 on the detected change region.

The display signal converter 2 converts the decoded picture 12 of the "previous frame" among the pictures decoded by the video decoder 1 into a display picture signal 15 and converts the decoded picture 13 of the "current frame" into a display picture signal 16.

In a normal mode which does not use the power saving mode of the system of the present invention for displaying a picture by rewriting the picture only in a change region, the display picture signal 16 of the "current frame" can be output to the crystal display unit so as to be used to rewrite the picture. By doing so, the present invention is also applicable to picture display by the conventional, normal control method.

In case of using the power saving mode of the system of the present invention for displaying a picture by rewriting the picture only in the change region, the display picture signal 15 of the "previous frame" and the change region address information 14 of the change region detector 3 can be output to the liquid crystal display unit so as to be used to rewrite the picture only in the change region. By doing so, it is possible to display the picture by rewriting it only in the change region.

Rewriting the picture only in the change region or the normal rewrite of the picture is designed to be realized if the display apparatus executes a display control method of executing the former or latter rewrite operation based on mode information for designating the corresponding mode.

The difference signal detector 4 obtains difference information 17 on the change region indicated by the change region address information 14 output from the change region detector 3 using the display picture signal 15 of the "previous frame" and the display picture signal 16 of the "current frame" output from the display picture converter 2, and outputs the difference information 17 to the display apparatus.

The present apparatus configured as stated above can select a normal display mode and a power saving display mode. In the normal display mode, input video encoded data 11 is decoded by the video decoder 1. This decoded signal is converted into a display picture signal 16 corresponding to the decoded picture of the "current frame" by the display signal converter 2 and transmitted to the crystal display unit.

If the display picture signal 16 is transmitted to the crystal display unit as a crystal drive signal, the crystal display unit generates a signal which serves as a grating corresponding to the display picture signal 16 while conducting normal scan by generating a scanning signal necessary to conduct the normal scan and displays the picture.

Meanwhile, in the power saving mode of the system of the present invention for displaying a picture by rewriting only the picture in the change region, the input video encoded data 11 is decoded by the video decoder 1 and the decoded signal is transmitted to the display signal converter 2 and the change region detector 3. The change region detector 3 obtains the difference between the decoded picture 12 of the "previous frame" and the decoded picture 13 of the "current frame" from the decoded pictures decoded by the video decoder 1 and detects a region having the difference as a change region. The change region detector 3 detects address information 14 on the change region.

The display signal converter 2 converts the decoded picture 12 of the "previous frame" and the decoded picture 13 of the "current frame" into the display video signals 15 and 16, respectively. The difference signal detector 4 obtains difference information 17 on the change region indicated by the change region address information 14 using the display picture signal 15 of the "previous frame" and the display picture signal 16 of the "current frame" among the pictures decoded by the picture decoder 1. The address information 14 and the difference information are transmitted, as a crystal drive signal, to the crystal display unit, thereby displaying pictures.

Figure 2A:
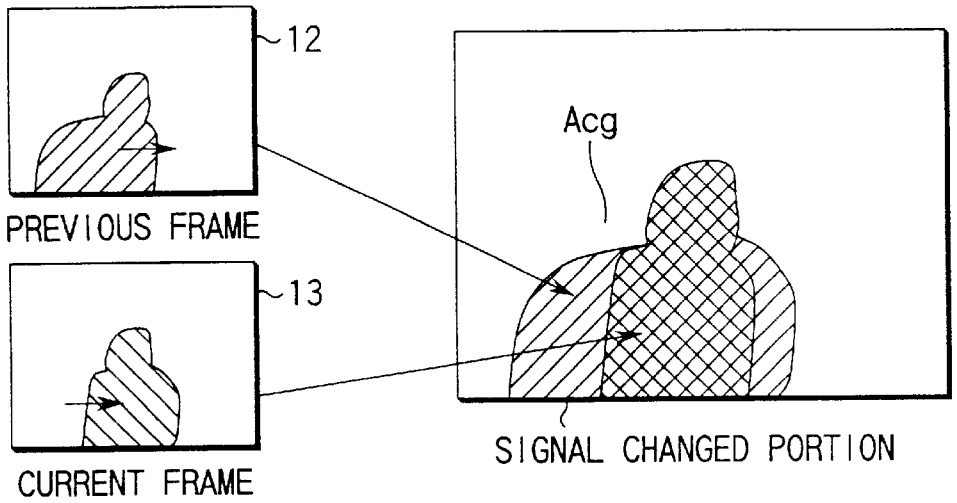
FIGS. 2A, 2B and 2C are explanatory views for the detection result of a change region detector in the apparatus shown in FIG. 1 and a rewritten region.

In addition, the detected change region can be set to have an arbitrary shape in units of pixels if the crystal panel of the crystal display unit used for display is configured to allow switching a drive signal for each pixel. Namely, as shown in FIG. 2A, a signal changed portion can be set as a change region Acg in the decoded picture 12 of the "previous frame" and the decoded picture 13 of the "current frame".

Figure 2B:
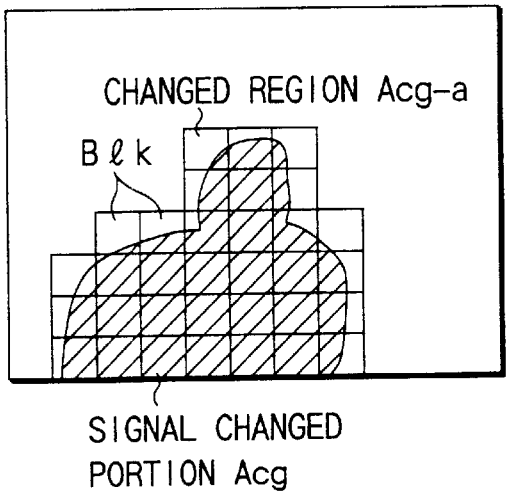
Figure 2C:
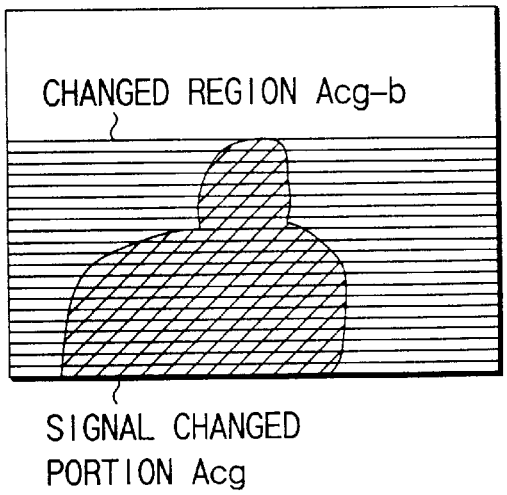

If a display method with which the crystal panel switches a drive signal in units of blocks is adopted, a set of blocks Blk containing the signal changed portion Acg is set as a change region Acg-a as shown in FIG. 2B. Further, a display method with which the crystal panel switches a drive signal in units of lines, a set of lines containing the signal changed portion Acg is set as a change region Acg-b as in the case of the above, as shown in FIG. 2C. If change region address is detected by using information as to whether the blocks Blk are "moved" or "not", the change region can be easily determined in units of blocks Blk.

Figure 3A:
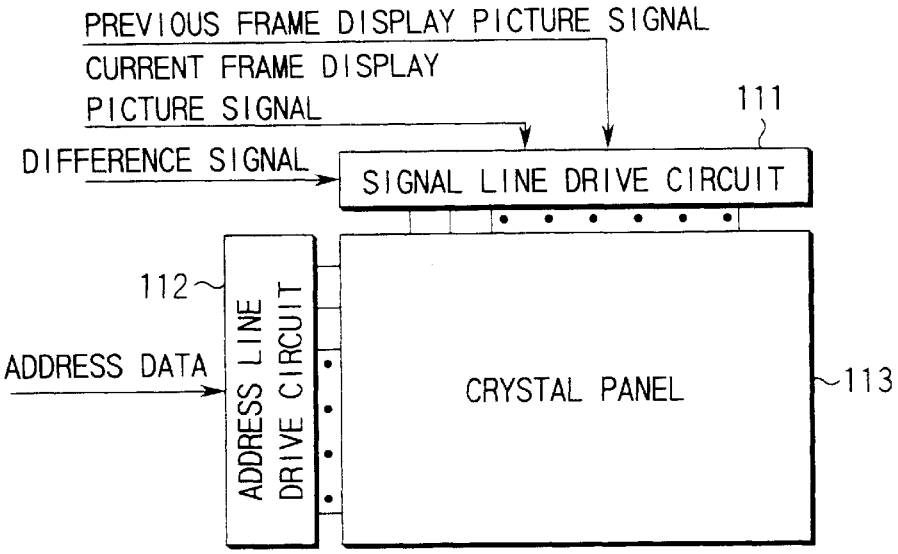
FIGS. 3A and 3B are explanatory views for an example of the configuration of a crystal display unit used in the present invention.
Figure 3B:
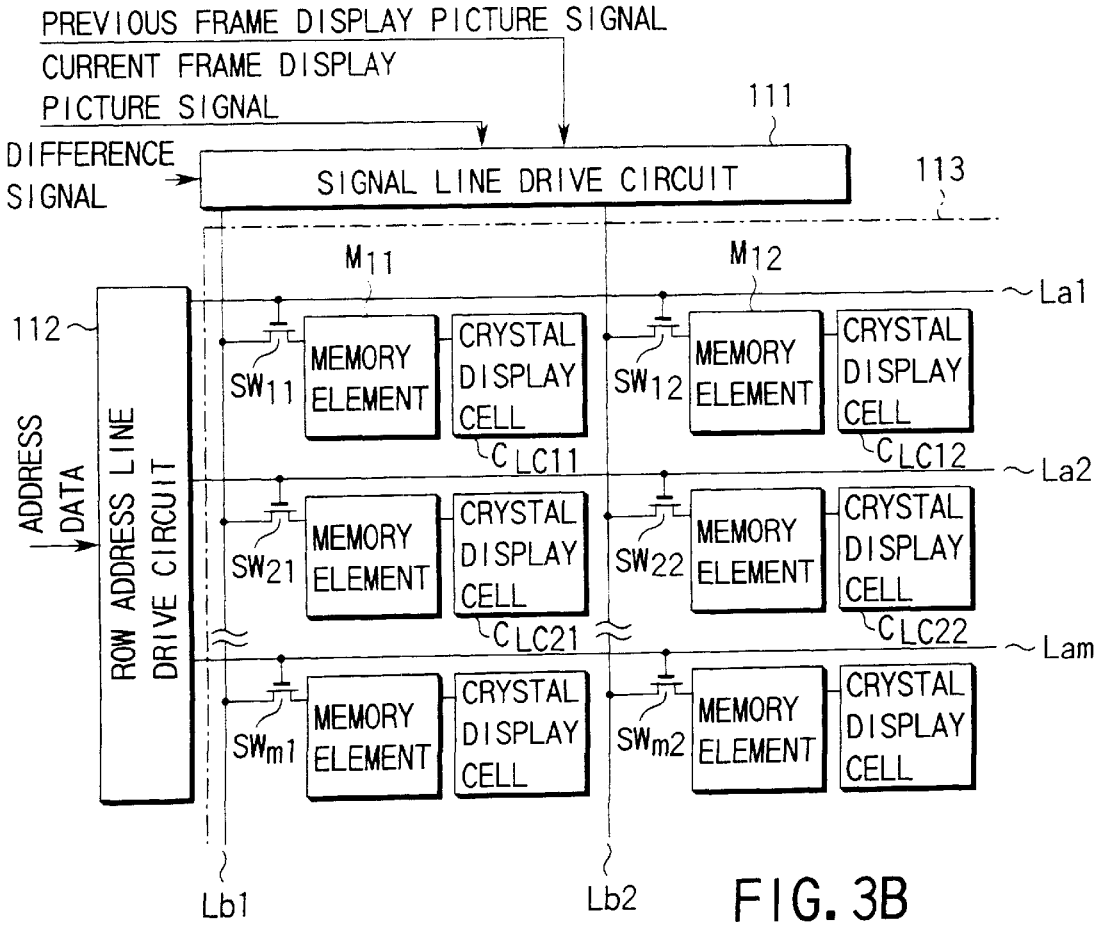

Next, the configuration of the crystal panel used in the liquid crystal display (LCD) apparatus unit will be described. The schematic, overall configuration of the crystal display unit is shown in FIG. 3A and an example of the array of the crystal panel is shown in FIG. 3B. As shown in FIG. 3A, the crystal display unit comprises a signal line drive circuit 111, an address line drive circuit 112 and a crystal panel 113.

The crystal panel comprises, as shown in FIG. 3B, row address signal lines La1, La2, . . . Lam (m=1, 2, 3, 4, . . . ) for introducing a row address signal from the address line drive circuit 112, signal lines Lb1, Lb2, . . . Lbn (n=1, 2, 3, 4, . . . ) for introducing a pixel signal from the signal line drive circuit 111, switches SWmn(m, n=1, 2, 3, 4, . . . ), crystal display cells ClCmn (m, n=1, 2, 3, 4, . . . ) containing pixel electrodes and memory elements Mmn (m, n=1, 2, 3, 4, . . . ).

The crystal panel 113 shown therein comprises a plurality of very small crystal display cells CLCmn (m, n=1, 2, 3, 4, . . . ) arranged in a matrix, row address lines La1, La2, . . . Lam functioning as scanning lines for driving rows (driving row address lines) in units of rows and signal lines Lb1, Lb2, . . . Lbn for selecting pixels in units of columns.

The crystal display cells ClCmn are connected to signal lines, positions of which correspond to those of the cells in the matrix through switches SWmn (m, n=1, 2, 3, 4, . . . ), respectively. Each switch SWmn is made of a transistor (Thin Film Transistor or TFT), the gate terminal of which is connected to the row address line which position corresponds to that of the switch in the matrix among the row address lines La1, La2, . . . Lam. If a row address line is selected, the switch SWmn is turned on and a picture signal corresponding to pixels supplied by the signal line is input to the memory element Mmn consisting of a capacitor. If the picture signal is held as a charge signal in the memory element Mmn and supplied to the crystal display cell CLCmn, the crystal display cell CLCmn displays the pixels with a density corresponding to the picture signal (or corresponding to a potential held by the capacitor).

The row address line drive circuit 112 sequentially supplies drive signals to the row scanning lines La1, La2, . . . Lam and controls the switches Swmn of the respective crystal display cells in units of rows. The signal line drive circuit 111 receives the above-stated difference signal 17 and the previous frame picture and generates a difference-added picture signal obtained by adding the difference signal 17 and the previous frame picture together. Based on the difference-added picture signal, electric signals corresponding to gray levels corresponding to the positions of pixels are created and output to the signal lines Lb1, Lb2, . . . , Lbn of the pixels, respectively.

By the cooperation between the signal line drive circuit 111 and the row address line drive circuit 112 for driving row scanning lines according to the address information on the change region, only the row scanning lines containing portions of a frame picture different in picture state from the previous frame can be driven for rewriting pictures.

In the crystal panel 113 configured as stated above, the difference signal (difference information) 17 output from the difference signal detector 4 shown in FIG. 1 is transmitted to the signal line drive circuit 111 and the address information 14 indicating the change region and output from the change region detector 3 is transmitted to the address line drive circuit 112.

The signal line drive circuit 111 of the crystal panel 113 generates a difference-added picture signal by adding the difference signal 17 and the previous frame picture together. Based on this difference-added picture signal, electric signals corresponding to gray levels corresponding to pixel positions are generated and output to the signal lines Lb1, Lb2, . . . Lbn of the corresponding pixels, respectively.

The address line drive circuit 112, which has been given the address information 14 indicating the change region, sequentially transmits drive signals to the row scanning lines La1, La2, . . . Lam corresponding to the address information 14 and controls the switches SWmn of the respective crystal display cells CLCmn in units of rows.

The switches SWmn connected to the row scanning lines La1, La2, . . . Lam supplied with the drive signals are turned on and the electric signals corresponding to gray levels corresponding to the pixel positions are input from the signal line drive circuit 111 to the crystal display cells CLCmn through the turned-on switches SWmn. The address line drive circuit 112 sequentially supplies drive signals to the row scanning lines La1, La2, . . . Lam corresponding to the address information 14 indicating the change region and controls the switches SWmn of the respective crystal display cells CLCmn in units of rows. By doing so, only the scanning lines containing portions of a frame picture different in picture state from the previous frame are driven to rewrite pictures. A display picture plane in case of rewriting pictures by this drive method is shown in FIG. 4B.

Now, if a signal line drive circuit capable of outputting eight bits is used as the signal line drive circuit 111 in the present system, the difference-added picture signal becomes a picture signal with "0" to "255" levels. FIG. 4B shows that the stage in which a difference-added picture signal is generated in response to the difference signal is provided in the signal line drive circuit 11. Alternatively, a frame memory may be provided in front of the signal line drive circuit 111. In the latter case, the change region address signal and the difference signal are input to the frame memory, converted to a difference-added picture signal and then transmitted to the signal line drive circuit 111.

Specific processing conducted by the address line drive circuit 112 may be arbitrarily determined. For example, the enable signal of the row address line drive circuit 112 is controlled in accordance with the address signal indicating the change region such that the enable signal is turned "ON" on the address line which belongs to the change region and turned "OFF" on the address line which does not belong to the change region.

Next, description will be given to a control method in write control sections (change region detector 3, signal line drive circuit 111 and row address line drive circuit 112) for write-controlling portions belonging to the change region and those which do not belong to the change region. This control method is intended to allow rewriting a picture in the change region in line with the change time by, for example, making a write order different from that of an ordinary method for sequentially writing the picture from the upper portion to the lower portion of the display region on the crystal panel.

Further, a rewrite order can be changed according to the size of the change region in the same frame. For example, as shown in FIG. 4B, in the crystal panel on which the picture is rewritten for each line, lines of a large change region or lines belonging to a change region having a large variation in the difference signal, are rewritten first.

Figure 4A:
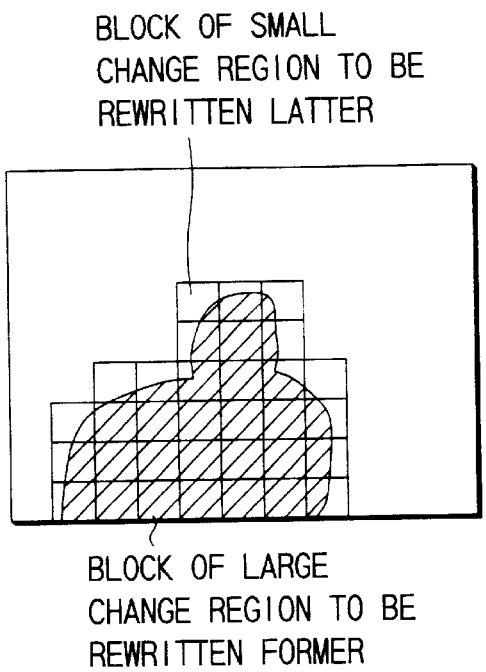
FIGS. 4A and 4B are explanatory views for a way to rewrite the change region in the first embodiment.
Figure 4B:
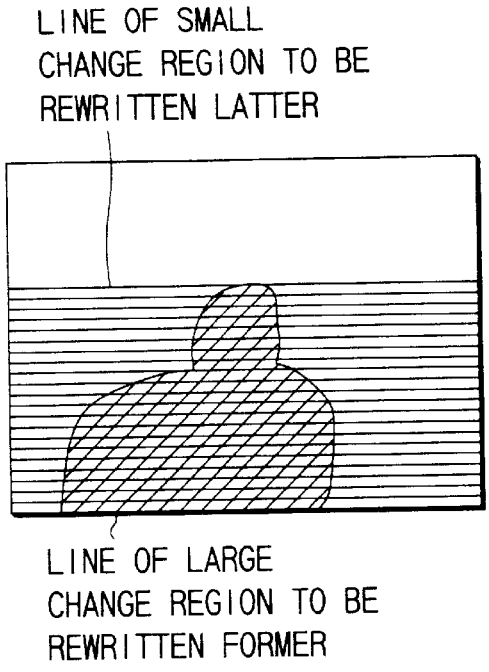

As shown in FIG. 4A, a crystal panel on which a picture is rewritten in units of blocks may be employed as well. In the crystal panel, as in the case of FIG. 4B, blocks belonging to a change region having a large variation in the difference signal can be rewritten first.

As for writing a picture in pixels which do not belong to the change region, if a liquid crystal material requiring polarity inversion is used for the crystal display cells of the crystal panel and rewrite operation is not conducted for a long time, the deterioration of picture quality such as sticking, which means that the material is separated and not returned to the original one, may possibly occur. Considering this, a drive method is employed so that polarity inversion can be made in a certain cycle.

In that case, if there is a slight change between luminance during (+) polarity write and that during (−) polarity write, flicker occurs following the change of luminance. The flicker tends to be more visible when the change of luminance is about 2% or more of display luminance and rewrite frequency is about 15 Hz. It is, therefore, preferable that rewrite frequency is set far higher or far lower than about 15 Hz.

Nevertheless, since the picture is rewritten for pixels which do not belong to the change region, it is undesirable to set rewrite frequency high in view of power saving. The present invention, therefore, adopts a method of suppressing the occurrence of flicker by decreasing rewrite frequency.

By doing so, if a drive method of conducting polarity inversion in a certain cycle is employed, good picture display can be ensured while suppressing the occurrence of flicker. While the rewrite-frequency depends on the characteristics of the liquid crystal material and on the change of luminance during rewrite operation, it is possible to make it hard for human eyes to recognize flicker by setting the rewrite frequency following polarity inversion for the pixels which do not belong to the change region at 5 Hz or lower.

As can be seen, in the first embodiment, a picture is rewritten, in units of pixels, on lines containing the change region or on unit blocks containing the change region among the picture in units of blocks. As for the unchanged lines or unchanged unit blocks, picture signals are basically not transmitted thereto to thereby maintain the previous picture state. This makes it possible to minimize rewrite operation, to minimize display-driving for the crystal panel and to realize power saving.

The above-stated description concerns an example in which rewrite control is conducted in units of pixels and a picture is rewritten, in units of pixels, on lines containing the change region or unit blocks containing the change region among the picture in units of blocks. Next, an example of enabling the acceleration of rewrite rate will be described as the second embodiment.

To accelerate rewrite rate in the change region of the picture, the second embodiment adopts a hardware configuration for carrying out rewrite operation in units of blocks. Further, the configuration of the second embodiment is such that, in addition to the configuration of the first embodiment, a column address line is provided for each pixel, switches each operable by the signal of the corresponding column address line are provided and a column address line drive circuit for driving the column address lines is provided so that rewrite control can be conducted to all the unit blocks containing the change region only once.

Figure 5:
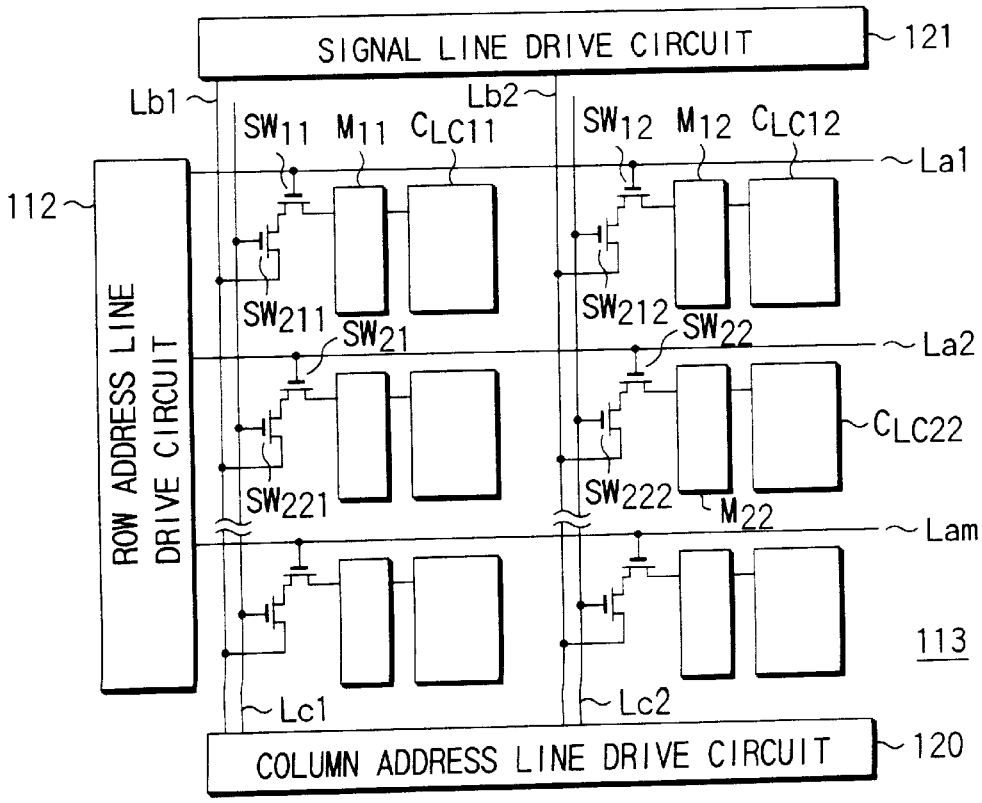
FIG. 5 is an explanatory view for another example of the configuration of the crystal display unit used in the present invention.

Namely, the configuration of the second embodiment is that shown in FIG. 5. As shown therein, a crystal panel 113 comprises a signal line drive circuit 111, a row address line drive circuit 112, a column address line drive circuit 120, row address lines La1, La2, . . . Lam (m=1, 2, 3, 4, . . . ), signal lines Lb1, Lb2, . . . Lbn (n=1, 2, 3, 4, . . . ), column address lines Lc1, Lc2, . . . Lcm (m=1, 2, 3, 4, . . . ), switches SWmn (m, n=1, 2, 3, 4, . . . ), the second switches SW2mn (m, n=1, 2, 3, 4, . . . ), memory elements Mmn (m, n=1, 2, 3, 4, . . . ) and crystal display cells CLCmn (m, n=1, 2, 3, 4, . . . ).

In case of utilizing liquid crystal having a memory effect or adopting a configuration in which the OFF resistance of a TFT is high (or resistance at a time the transistor is turned off is set high) and current leak is slight, the crystal panel does not necessarily comprise the memory elements stated above.

The crystal panel 113 exemplified in FIG. 5 is a display element unit having a plurality of very small crystal display cells CLCmn (m, n=1, 2, 3, 4, . . . ) arranged in a matrix. The crystal panel 113 is provided with the row address lines La1, La2, . . . Lam which are scanning lines for driving rows in units of rows (or driving the row address lines), the signal lines Lb1, Lb2, . . . Lbn transmitting signals for displaying a picture in units of columns, and the signal lines Lc1, Lc2, . . . Lcn for selecting pixels in units of columns. The crystal display cells CLCmn are connected to the signal lines positions of which correspond to the positions of the cells in the matrix through the memory elements Mmn (m, n=1, 2, 3, 4, . . .) and the switches SWmn (m, n=1, 2, 3, 4, . . .), respectively.

Each of the switches SWmn and SW2mn is formed of a transistor (TFT). The gate terminals of the switches SW2mn are connected to the column address lines Lc1, Lc2, . . . Lcm which positions correspond to those of the switches in the matrix, respectively. The gate terminals of the switches SWmn are connected to the row address lines which positions correspond to the positions of the switches in the matrix, respectively. By selecting row address lines and column address lines to turn on the corresponding paired switches SWmn and SW2mn, picture signals supplied by the signal lines are input to the memory elements Mmn each of which is formed of a capacitor, through the switches SW2mn and SWmn and the picture signals are held as charge signals in the memory elements Mmn, respectively. Each of the charge signal is supplied to the crystal display cell CLCmn, whereby the crystal display cell CLCmn displays pixels with a density corresponding to the picture signal (or corresponding to the potential held by the capacitor).

The row address line drive circuit 112 is provided to supply drive signals to the row scanning lines La1, La2, . . . Lam, respectively, and to sequentially drive-control the switches of the respective crystal display cells in units of rows. Further, this row address line drive circuit 112 generates drive signals for scanning the positions of rows corresponding to the change region in accordance with address information 14 on the change region output by the change region detector 3 and supplies the drive signals to the corresponding row scanning lines, respectively. The signal line drive circuit 111 functions to receive a difference signal 17 and a previous frame picture as stated above, to obtain a difference-added signal by adding them together, to generate electric signals corresponding to gray levels corresponding to the positions of pixels based on this difference-added picture signal and to output the electric signals to the signal lines Lb1, Lb2, . . . Lbn of the corresponding pixels, respectively.

The column address line drive circuit 120 is provided to sequentially supply drive signals to the column scanning lines Lc1, Lc2, . . . Lcm, respectively, and to drive-control the switches SW2mn of the respective crystal display cells in units of columns. Also, the column address line drive circuit 120 generates drive signals for scanning the positions of columns corresponding to the change region in accordance with address information 14 on the change region output from the change region detector 3 and supplies the drive signals to the corresponding column scanning lines, respectively.

In the crystal panel 113 configured as stated above, the difference signal (difference information) 17 output from the configuration shown in FIG. 1 is fed to the signal line drive circuit 111, and the address information 14 indicating the change region is fed to the row address line drive circuit 112 and the column address line drive circuit 120.

The signal line drive circuit 111 of the crystal panel 113 generates a picture signal (difference-added picture signal) reconstructed by adding together the difference signal 17 and the previous frame picture. Based on this difference-added picture signal, the signal line drive circuit 111 generates electrical signals corresponding to gray levels corresponding to the positions of pixels and outputs the electrical signals to the signal lines Lb1, Lb2, . . . Lbn of the corresponding pixels.

Meanwhile, the row address line drive circuit 112 supplied with the address information 14 indicating the change region, sequentially transmits drive signals to the row scanning line La1, La2, . . . and Lam corresponding to the address information 14, and controls the switches SWmn of the respective crystal display cells CLCmn in units of rows.

Further, the row address line drive circuit 120 supplied with the address information 14 indicating the change region, sequentially transmits drive signals to the column scanning lines Lc1, Lc2, . . . Lcm 15 corresponding to the address information 14, and controls the switches SWmn of the respective crystal display cells CLCmn in units of columns.

The switches SWmn connected to the row scanning lines La1, La2, . . . Lam supplied with the drive signals 20 are turned on and the switches SW2m connected to the column scanning lines Lc1, Lc2, . . . Lcm supplied with the drive signals are turned on. Through the switches SWmn and SW2mn which have been turned on, electric signals corresponding to gray levels corresponding to the positions of pixels are input to the crystal display cells CLCmn by the signal line drive circuit 111.

The row address line drive circuit 112 and the column address line drive circuit 120 sequentially supply drive signals to the row scanning lines La1, La, . . . Lam and the column scanning lines Lc1, Lc2, . . . Lcm corresponding to the address information 14 indicating the change region, respectively. The switches SWmn of the respective crystal display cells CLCmn are drive-controlled in units of rows by these drive signals. As a result, only the row scanning lines containing portions different in picture state from the one-frame previous frame among the frame pictures are driven so as to rewrite the picture.

The crystal panel 113 has an array as shown in FIG. 5. The signal line drive circuit 111 can supply picture signals for the pixels in a plurality of rows, and the row address line drive circuit 112 and the column address line drive circuit 120 select rows and columns to be display-controlled. By doing so, the pixels to be display-controlled can be selected not only in units of pixels but also in units of sets of a plurality of pixels, to thereby allow writing the picture for a pixel or a set of pixels belonging to the change region of the picture.

It is noted that a unit for writing a picture for a pixel or a set of pixels belonging to the change region of the picture may be different from a unit for writing a picture for a pixel or a set of pixels which do not belong to the change region. To write a picture in the change region, the row address lines and column address lines belonging to the change region are selected. The selection unit be freely chosen and may be changed according to the arrangement of the change region.

Figure 6:
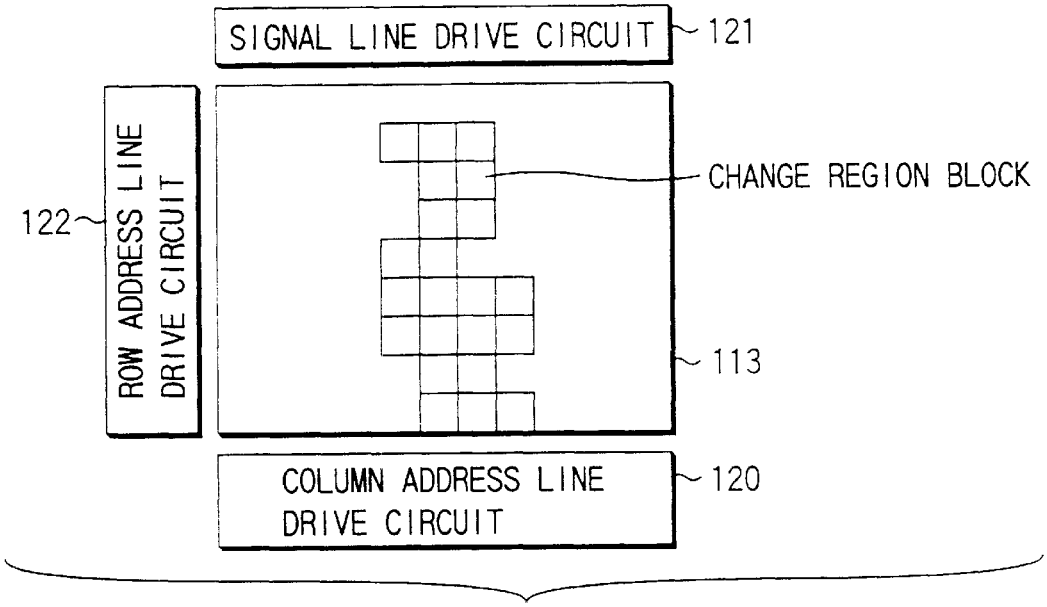
FIG. 6 is an explanatory view for an example of display-drive control over the crystal display unit used in the present invention in block units.

As shown in, for example, FIG. 6, it is assumed that the change region is arranged to have more blocks in horizontal direction than in vertical direction on the crystal panel. In this case, after the column address lines belonging to the change region are selected, the clock of the column address line drive circuit 120 is stopped to hold the state in which the column address lines are selected and the column address lines are sequentially scanned.

By so controlling, power consumption following the potential changes of the column address lines and that in the column address line drive circuit can be reduced. This control method is particularly effective if the change region is hardly moved and the pictures in the change region are often rewritten.

Figure 7:
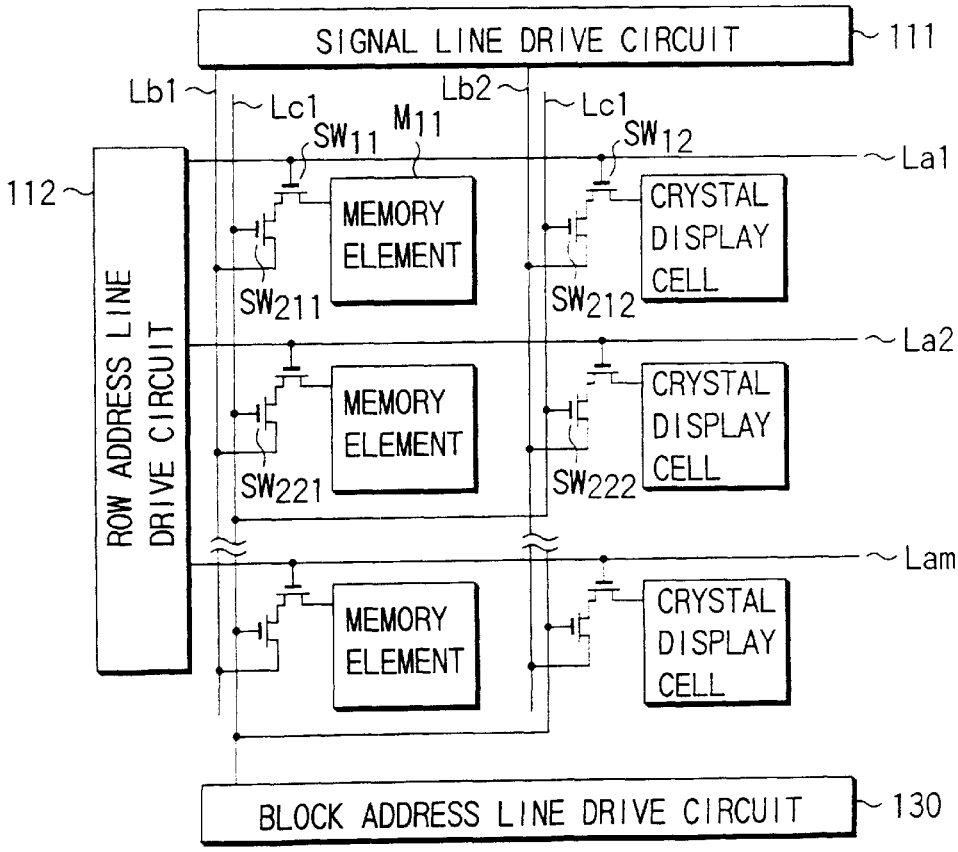
FIG. 7 is an explanatory view for another example of the configuration of the crystal display unit used in the present invention.

FIG. 7 shows the configuration of an array in which two or more plural pixels in column direction are selected as one block. That is, the column address line drive circuit 120 shown in FIG. 5 is replaced by a block address line drive circuit 130 for selecting addresses in units of columns corresponding to a block. Column scanning lines Lc1, Lc2, . . . Lcm are grouped together in units of blocks. In case of, for example, the MPEG system having a processing unit for processing a picture in units of blocks of N×N pixels, N pixels are grouped into one block. That is to say, the column scanning lines Lc1 to LcN are grouped together and, the column scanning lines LcN+1 to Lc2N are grouped together and the column scanning lines Lc2N+1 to Lc3N are grouped together. Accordingly, if drive signals are applied to the group of the column scanning lines Lc1 to LcN, then switches SW211 to SW21N, SW221 to SW22N, SW231 to SW23N, SW241 to SW24N, . . . gates of which are connected to the column scanning lines Lc1 to LCN, respectively, are turned on, that is, the switches connected to the selected group of column scanning lines Lc1 to LcN, respectively, are turned on. Thus, in the MPEG system having a processing unit for processing a picture in units of blocks of N×N pixels, N pixels can be regarded as one block.

In this example, a set of adjacent R, G and B elements forming one dot are considered one pixel as a minimum unit. If R, G and B are counted separately as one dot, 3N pixels (N pixels×3) can be considered one block.

If a picture is rewritten in units of pixels for lines containing the change region or the unit blocks containing the change region among the picture in units of blocks, the rewrite operation is conducted for the large changed portions prior to the small changed portions in the change region. This makes it possible to accelerate rewrite rate.

Next, description will be given to the third embodiment capable of saving power in rewriting a picture in the change region.

In the first embodiment stated above, the crystal panel has an array in which memory elements Mmn (m, n=1, 2, 3, 4, . . . ) are interposed between the switches SWmn and crystal display cells CLCmn (m, n=1, 2, 3, 4, . . . ), respectively, and the memory cells Mmn can hold picture signals corresponding to a plurality of frames. In case of writing a picture to the memory elements Mmn corresponding to the crystal display cells CLCmn corresponding to "pixels or pixel groups belonging to the change region" to be rewritten, a write unit for the pixels belonging to the change region is made different from a unit for the pixels which do not belong to the change region.

For example, to provide different gradation display methods to the change region and the unchanged region, the unchanged region is displayed by means of a normal gradation display method and the change region is displayed by means of a dither scheme to thereby lower gradation in the change region. With this method, the picture signals output by the signal line drive circuit 111 are picture signals according to the normal gradation display method in the unchanged region and those according to the dither scheme in the change region.

As for the change region or particularly the continuously change region of a picture, it is difficult for human eyes to perceive the resolution of the region due to the human biological properties. Utilizing this, the picture in a moving region is displayed according to the dither scheme and the resolution of the picture is lowered. To lower resolution means that the number of bits of information can be reduced, resulting in less data transmission time. Therefore, it is possible to rewrite the picture in the change region within a one-frame time and there is less fear of deteriorating apparent display quality.

The above-stated normal gradation display method is a method for allotting a voltage level from among "256" levels to each pixel according to an input gradation signal (e.g., eight-bit signal for voltages of "0" to "255" levels). In contrast, spatial grading is lowered by the dither scheme in the change region and an intermediate gradation is displayed by compensating for the gradation between adjacent pixels. By doing so, the number of gradations can be reduced in the change region and power consumption can be reduced, accordingly. Next, description will be given to an example of applying the present invention to a case where a liquid crystal material having hysteresis characteristics is used for the crystal panel as the fourth embodiment.

There are crystal display cells using a liquid crystal material having hysteresis characteristics. If such crystal display cells are employed, in the configuration of the first embodiment stated above, a display control method such that reset signals to clear picture signals are written to pixels belonging to the change region and thereafter picture signals are written thereto and that the picture signals of the previous frame are input or picture signals are not input to pixels which do not belong to the change region.

Figure 8:
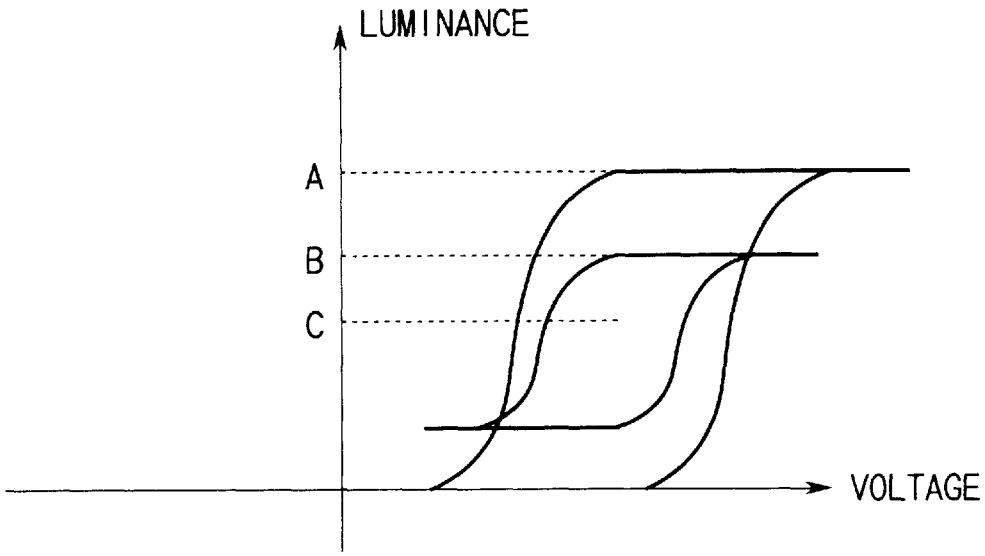
FIG. 8 is a characteristic view for explaining the difference in applied voltage at the time of obtaining a certain display picture density while a liquid crystal material having hysteresis characteristics is used.

With this method, if a liquid crystal material having hysteresis characteristics such as, for example, luminance-voltage characteristics shown in FIG. 8, the residual components of the previous picture are removed and a current picture can be displayed for the pixels belonging to the change region and no picture signals are input to the pixels which do not belong to the change region, whereby it is possible to realize power saving.

The crystal display cells using the liquid crystal material having hysteresis characteristics are influenced by the picture signals of the previous frame when next picture signals are written thereto. For example, even if the current picture is displayed with, for example, the same "C" luminance level, voltages to be input differ between a case where the previous frame is displayed with an "A" luminance level and a case where the previous frame is displayed with a "B" luminance level.

Figure 9:
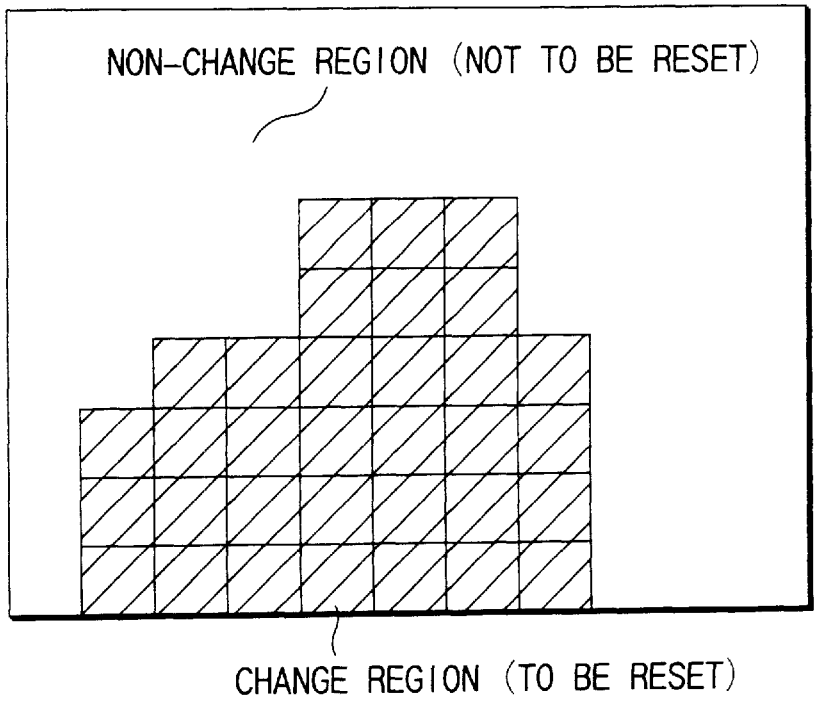
FIG. 9 is an explanatory view for an example of reset-control over the crystal display unit used in the present invention.
Figure 10:
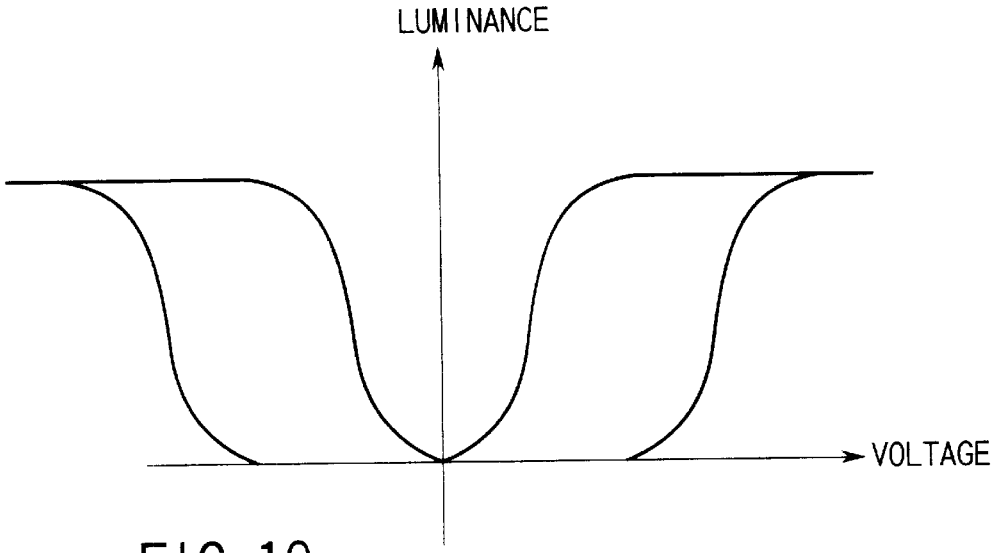
FIG. 10 shows an example of the characteristics of the liquid crystal material having hysteresis characteristics.

To solve the above disadvantage, there is proposed a method of resetting the crystal display cells once at the time of switching display. As shown in FIG. 9, when a frame is switched to another frame, reset signals are input to a plurality of pixels belonging to the change region. The reset signals may be arbitrary. A display apparatus having hold characteristics such as the crystal display unit may be sometimes faced with a problem of display blur due to the fact that the residual display of the previous frame and the display of the current frame coexist on a single frame. To avoid this, the cells are reset to execute black display. Alternatively, as shown in FIG. 10, a liquid crystal apparatus using an antiferroelectric crystal material (to be referred to as "AFLC" hereinafter) adopts a display method for executing black display once and then writing a picture with inverse polarity at the time of polarity inversion. Due to this, it is possible to ensure resetting cells to execute white display with inverse polarity rather than black display.

Considering this, the cells are reset to execute white display. It is noted that the crystal display unit described herein is provided with a polarizing plate so as to execute black display at a voltage of 0[V].

As stated above, in case of rewriting pixels in the change region, the crystal display cells for these pixels are reset once and then picture signals are applied to the cells to thereby display the pixels. By doing so, even the crystal display unit using a liquid crystal material having hysteresis characteristics can rewrite the picture only in the change region without causing the deterioration of picture quality and can realize power saving.

Next, an example of the improved response characteristics of the liquid crystal of a crystal display unit using a liquid crystal material having slow response characteristics will be described as the fifth embodiment.

If the liquid crystal material has slow response characteristics, a configuration in which a write time for pixels belonging to the change region is set longer than that for pixels which do not belong to the change regions, is adopted in the configuration of the first embodiment.

If the write time for the pixels belonging to the change region is set longer than that for the pixels which do not belong to the change region, it is possible to improve response characteristics in a one-frame time.

If the liquid crystal material used for the crystal panel cannot sufficiently respond to the time for selecting one scanning line and a desired display level cannot be attained as in the case of, for example, the antiferroelectric crystal material, there is fear that an undesired display picture is displayed due to the insufficient response characteristics.

That is to say, although the antiferroelectric crystal material has faster response characteristics than a twist-nematic type liquid crystal material, it has a high liquid crystal capacity following spontaneous polarization. Owing to this, there is fear that it cannot sufficiently respond to time for selecting one scanning line in frame display scanning and that a desired display level cannot be attained. This phenomenon is particularly conspicuous if polarity inversion is carried out. However, picture quality can be improved by making the write time during polarity inversion longer.

Figure 11:
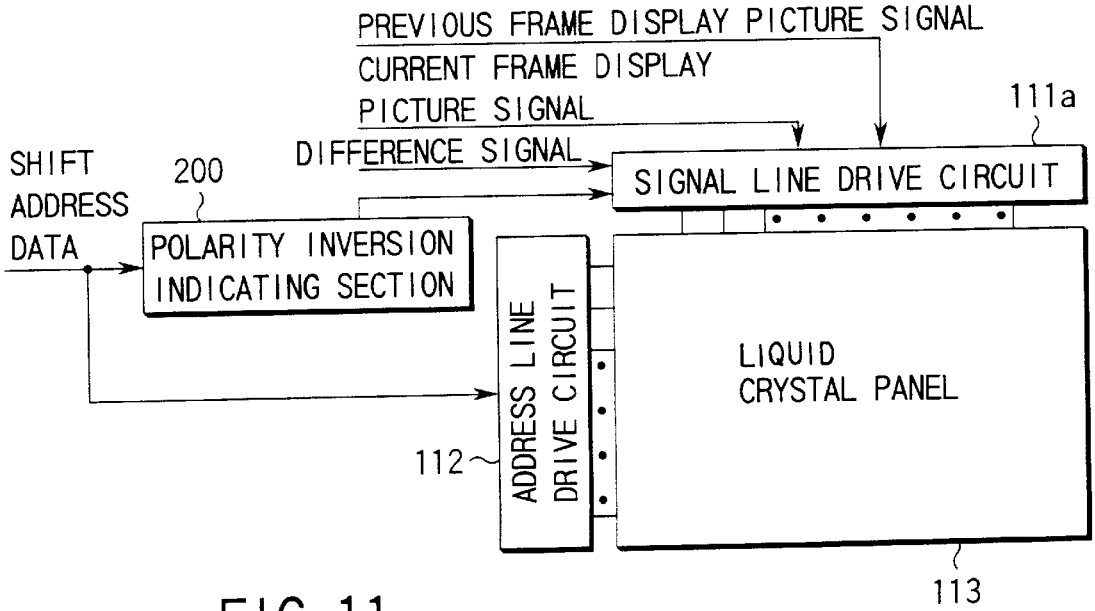
FIG. 11 is an explanatory view for another example of the configuration of the crystal display unit used in a fifth embodiment according to the present invention.
Figure 12:
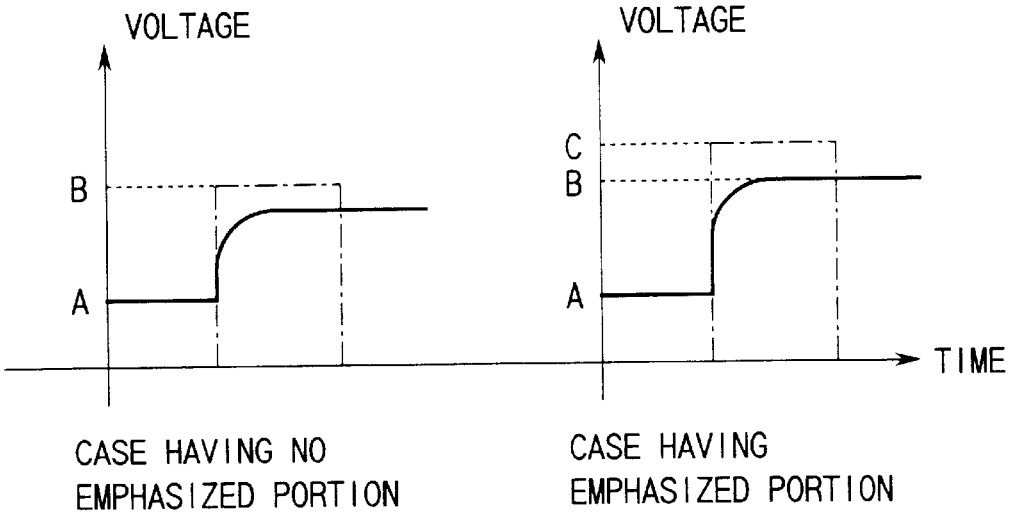
FIG. 12 is an explanatory view for a sixth embodiment according to the present invention.

In view of this, as shown in FIG. 11, a signal line drive circuit lila capable of inverting the polarity of a picture signal and outputting the picture signal in response to the indication of polarity inversion is used as the signal line drive circuit 111 and a polarity inversion indicating section 200 for indicating polarity inversion by employing shift address data is used. The signal line drive circuit 111*a* inverts the polarity of a picture signal and outputs the picture signal in accordance with the indication of polarity inversion from the polarity inversion indicating section 200.

Further, the signal line drive circuit 111*a* has a function to adjust the sharing of picture signal output time so that a write time for pixels belonging to the change region is longer than that for pixels which do not belong to the change region within a one-frame time for picture scanning.

The present apparatus configured as stated above operates as follows in the power saving display mode.

The difference signal detector 4 in the configuration of FIG. 1 obtains difference information 17 on the change region indicated by the change region address information 14 output from the change region detector 3, using the display picture signal 15 of the "previous frame" and the display picture signal 16 of the "current frame" output from the display signal converter 2, and outputs the difference information 17 to the signal line drive circuit 111*a*.

On the other hand, based on the change region address information 14 output from the change region detector 3, the polarity inversion indicating section 200 outputs an indication signal for indicating that the polarity of the picture signals should be inverted for the change region and outputs an indication signal for indicating that the picture signals should be output with the same polarity as that of the previous frame for the unchanged region, to the signal drive circuit 111*a*. Due to this, the signal line drive circuit 11*a* outputs picture signals to the signal lines of the corresponding pixels in the change region of the frame picture by inverting the polarity of the signals and outputs picture signals to the signal lines of the corresponding pixels in the unchanged region of the picture frame without inverting polarity thereof so as to write picture signals having the same polarity as that of the previous frame to the region or does not generate picture signals in the unchanged region of the frame picture.

It is noted that the signal line drive circuit 11*a* adjusts the sharing of picture signal output time so that a write time for the pixels belonging to the change region is longer than that for the pixels which do not belong to the change region within a one-frame picture time. Accordingly, if the liquid crystal material has slow response characteristics, write time is shared so that a write time for the pixels belonging to the frame picture change region is longer than that for the pixels which do not belong to the change region, thereby improving the response characteristics of the liquid crystal within a one-frame time.

If the polarity inversion indicating section 200 adopts a control method of outputting a signal indicating that the polarity of the picture signals should be inverted for the change region and of outputting an indication signal for indicating that the picture signals "should be written" or "should not be written" with the same polarity as that of the previous frame for the unchanged region, then it is necessary to know with which polarity the picture signals are written for all the pixels on the crystal panel. To be able to know which polarity is used to write picture signals, a frame memory storing polarity states is required. In that case, however, it suffices to prepare a one-bit memory per pixel, so that the use of frame memory does not increase the number of circuits so greatly.

The above description concerns an example of the improved response characteristics of the liquid crystal in case of the crystal display unit using a liquid material having slow response characteristics.

Next, description will be given to the sixth embodiment for a display method without using a reset section.

In the sixth embodiment, the following configuration is adopted in the configuration of the first embodiment so that a reset section can be dispensed with in the power saving display mode. In other words, amplified picture signals are written to pixels belonging to change region in view of the response characteristics of the liquid crystal material and the same picture signals as those for the previous frame are written to unchanged region for purpose of holding the previous frame or no picture signals are written thereto, Specifically, the difference signal detector 4 in the configuration shown in FIG. 1 has a function to reconstruct a difference signal as an emphasized portion added signal so as to improve picture quality.

While assuming, for example, that luminance levels A, B and C satisfy the relationship of A<B<C, a case where a picture is changed from a display picture with the luminance level A to that with the luminance level B is considered. In that case, if a voltage corresponding to the display of the picture with the luminance level B is merely applied to the electrodes of the crystal display cells, the liquid crystal material cannot sufficient respond to the change within a one-frame time due to slow response characteristics thereof. In contrast, if a voltage corresponding to the display of the picture with the luminance level C higher than the voltage corresponding to the display of picture with the luminance level B is applied to the electrodes of the crystal display cells, it is possible to eventually attain a picture display state with the luminance level B within the one-frame time.

Consequently, if a picture display voltage is corrected while the response characteristics of the liquid crystal material is reflected on the voltage, it is possible to change the luminance level of the picture to a desired level for display within a one-frame picture display time and to thereby improve the response characteristics of the liquid crystal material.

In that case, the emphasized portion added difference signal becomes a difference signal showing the difference between the display picture with the luminance level A and that with the luminance level C. Actually, table data corresponding to the respective gradation levels are prepared in the difference signal detector 4 and an emphasized component-added difference signal is read from the table data only for the change region which has a change between the previous frame and the current frame. This difference signal is fed to the memory-mounted crystal display unit as shown in FIGS. 3A and 3B and a voltage corresponding to a display signal necessary to display a picture with the luminance level C is applied to the pixel electrodes of the crystal display cells.

Furthermore, in the crystal display cells using the liquid crystal material having hysteresis characteristics as shown in, for example, FIG. 8, the writing of the next picture signal is influenced by the picture signal of the previous frame. Even if the current picture is displayed with, for example, the same "C" luminance level, voltages to be input differ between a case where the previous frame is displayed with the "A" luminance level and a case where the previous frame is displayed with the "B" luminance level.

Thus, the difference signal detector 4 reconstructs a difference signal as a conversion signal while matching the table data with a hysteresis waveform, that is, the detector 4 reconstructs a difference signal converted by reflecting the hysteresis characteristics of the liquid crystal material on the table data.

If conducting level-controlling as stated above, it is possible to realize a display method without use of a reset section by directly applying picture signals necessary to display the next picture, although it is naturally necessary to reset the charge of the picture signals used for the display of the previous frame.

The circuit arrangement which can dispense with reset operation means that it is not necessary to return the potentials of the display cells to a reset potential. Therefore, it is not necessary to decrease the potentials down to the reset level and to recharge the display cells with voltages necessary to display a picture. This follows that the picture signals of the previous frames are not discarded but can be effectively utilized and that power consumption can be thereby reduced. Thus, this also leads to power saving.

The change region detector 3 in the first embodiment stated above may be replaced by a change region detector 511 in the seventh embodiment which will be described later.

Next, an optimal example of applying the present invention to MPEG-4 will be described as the seventh embodiment.

An example of applying the configuration of the first embodiment to MPEG-4 will now be described.

Figure 13:
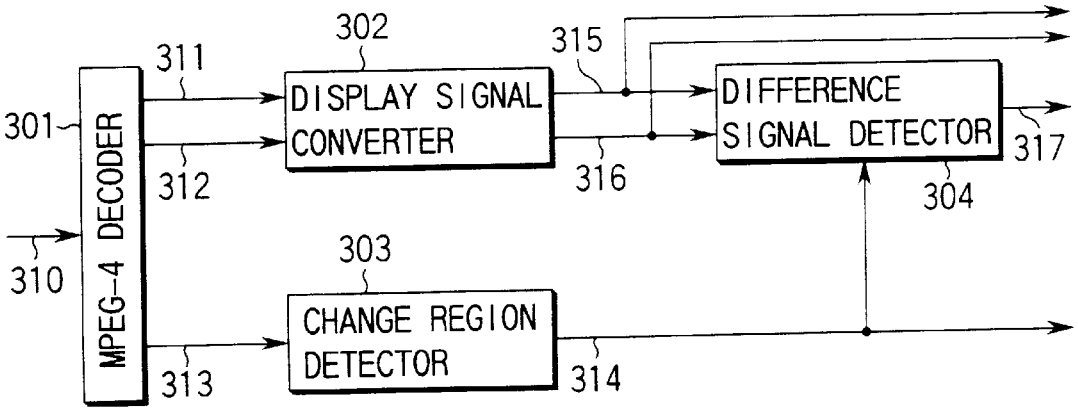
FIG. 13 is an explanatory view for a seventh embodiment according to the present invention.

Description will be given to this example with reference to FIG. 13. As shown therein, this system comprises an MPEG-4 decoder 301, a display signal converter 302, a change region detector 303 and a difference signal detector 304.

The MPEG-4 decoder 301 decodes picture data 310 compression-encoded according to the MPEG-4 method and reproduces information on the position of a coded region (called Bounding Box) and information 313 on the shape of an object. Further, the MPEG-4 decoder 301 decodes and outputs texture information 311 on the "previous frame" and texture information 312 on the "current frame".

The display signal converter 302 converts the texture information 311 on the "previous frame" and the texture information 312 on the "current frame" among the outputs of the MPEG-4 decoder 301 into display picture signals 315 and 316, respectively. Further, in the normal mode which does not use the power saving mode of the system of the present invention for displaying a picture by rewriting only the picture in the change region, the display signal converter 302 is configured so that the display picture signal 316 of the "current frame" can be output to the crystal display unit so as to be used to rewrite the picture. By doing so, it is possible to display the picture by the conventional, normal control method.

In case of using the power saving mode of the system of the present invention for displaying the picture by rewriting the picture only in the change region, the display signal converter 302 is configured so that the display picture signal 315 of the "previous frame" and the change region address information 314 of the change region detector 303 can be output to the liquid crystal display unit so as to be used to rewrite the picture only in the change region. By doing so, it is possible to display the picture by rewriting it only in the change region.

Rewriting the picture only in the change region or the normal rewrite of the picture is designed to be realized if the display apparatus executes a display control method of executing the former or latter rewrite operation based on mode information for designating the corresponding mode.

The change region detector 303 receives the display picture signal 315 of the "previous frame" and the display picture signal 316 of the "current frame" output from the MPEG-4 decoder 301, obtains the change region of the display picture signal 316 of the "current frame" with respect to the display picture signal 315 of the "previous frame", and outputs address information 314 on the change region. Using the display picture signal 315 obtained from texture information 311 on the "previous frame", the display picture signal 316 obtained from texture information 312 on the "current frame" output from the display signal converter 302 and the change region address information 314 output from the change region detector 303, the difference signal detector 304 obtains the difference 317 of the change region of the picture indicated by the change region address 314.

With this configuration, either the normal display mode or the power saving display mode can be selected. In the normal display mode, the MPEG-4 decoder 301 decodes the picture data 310 which has been compression-encoded according to the MPEG-4 method. In the display signal converter 302, the decoded signals 311 allow converting the texture information 312 on the "current frame" supplied from the MPEG-4 decoder 301 into a display picture signal 316. This display picture signal 316 is supplied to the liquid crystal display unit as a liquid crystal drive signal. The crystal display unit generates scanning signals necessary for normal scan and conducts normal scan and, at the same time, generates a signal serving as a gradation corresponding to the display picture signal 316 and display the picture.

Figure 20:
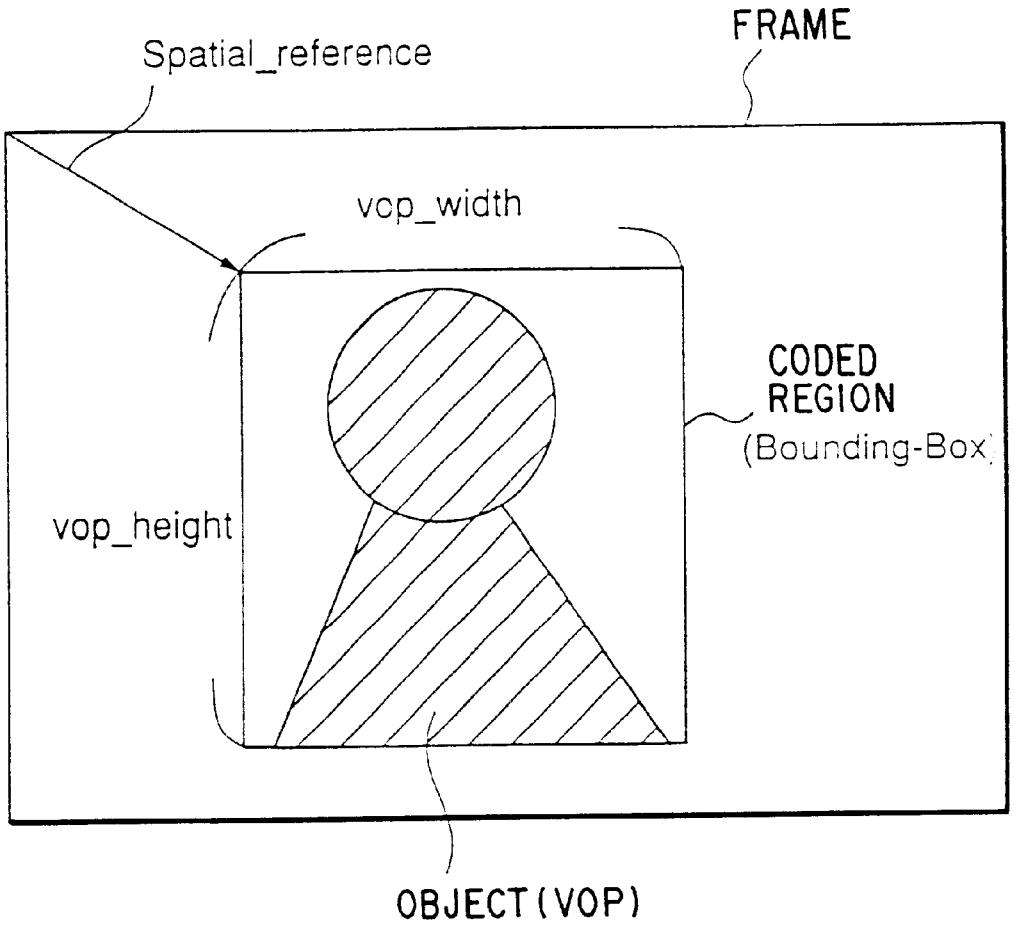
FIG. 20 is an explanatory view for coding an arbitrary shape object in MPEG 4.

Meanwhile, in case of using the power saving mode of the system of the present invention for displaying a picture by rewriting the picture only in the change region, the MPEG-4 decoder 301 receives and decodes the picture data 310 which has been compression-encoded according to the MPEG-4 method and obtains the size (vop-width, vop-height) and positional vector (Spatial-reference) of the Bounding-Box (coded region) including an object (VOP) as shown in FIG. 20. The MPEG-4 decoder 301 also obtains the information on the position of the Bounding-Box and the information 113 on the shape of the object. The MPEG-4 decoder 301 decodes the texture information 311 on the "previous frame" and the texture information 312 on the "current frame" from the picture data 310.

The change region detector 303 sets the region including the object before moving and that after moving contained in the Bounding-Box which position is changed between the previous frame and the current frame, based on the information on the position of the Bounding-Box and the information 313 on the shape of the object, and detects the change region address 314.

The display signal converter 302 converts the texture information 311 on the "previous frame" and the texture information 312 on the "current frame" supplied from the MPEG-4 decoder 301 into display signals 315 and 316, respectively and supplies the signals 315 and 316 to the difference signal detector 304. The difference signal detector 304 obtains the difference 317 of the change region indicated by the change address 314 using the display signal 315 of the "previous frame" and the display signal 316 of the "current frame" output from the display signal converter 302. Among the signals thus obtained, the change region address information 314 and the difference signal 317 are used as crystal drive signals.

The change region detected by the change region detector 303 corresponds to a portion in which the position of the Bounding-Box is moved or to a portion in which the shape of the interior of the Bounding-Box is changed between the decoded picture of the "previous frame" and that of the "current frame".

It is also possible to add the portion in which there is a difference between the decoded pictures of the previous and current frames or motion blocks to the change region as described in the first embodiment. In that case, the data 313 input to the change region detector 303 includes shape information, the decoded pictures of the previous and current frames and mode information indicating whether or not blocks are in motion.

Description will now be given to operation for determining the change region only by using the shape information as well as to the data communication with the interior of the MPEG-4 decoder 310 in detail.

Figure 14:
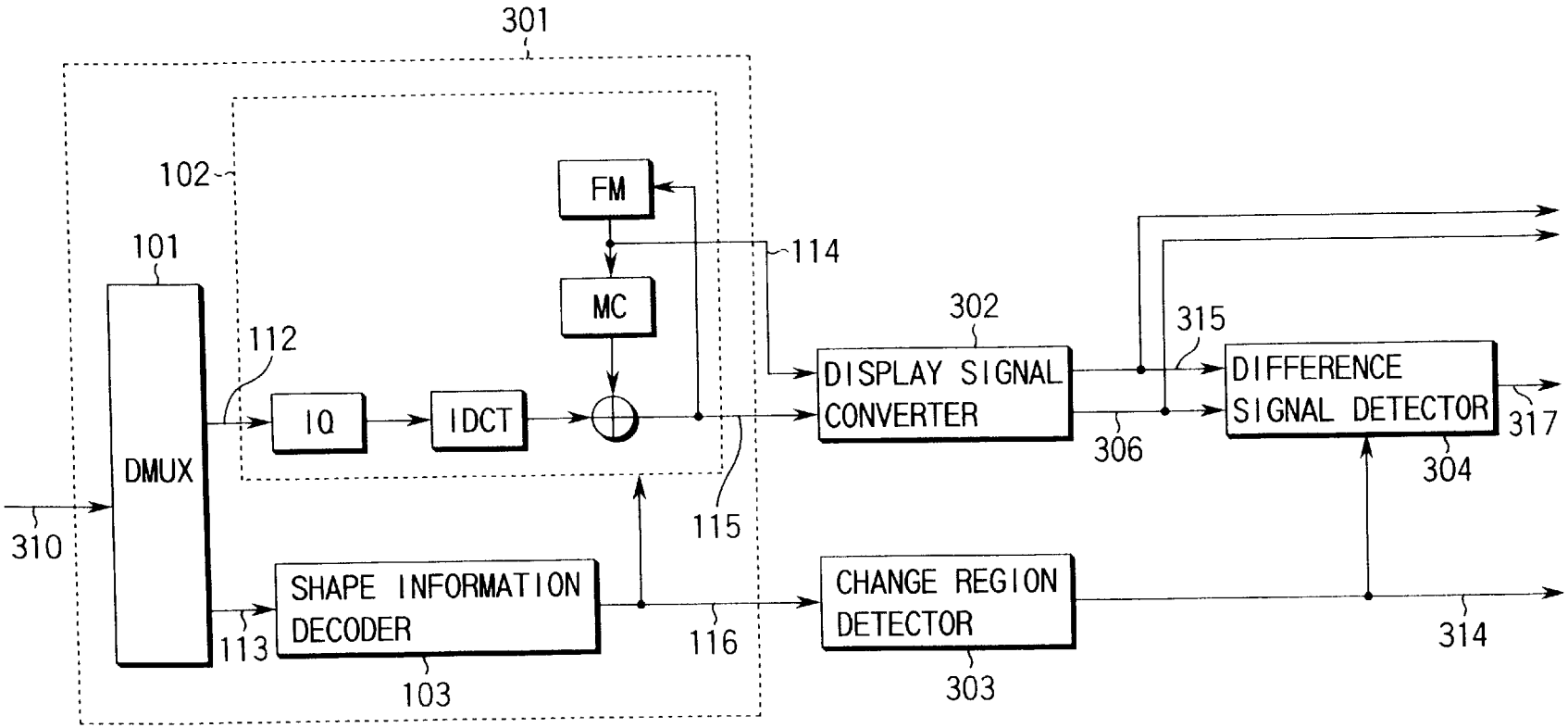
FIG. 14 is a block diagram of a system configuration including the detailed inside configuration of the MPEG-4 decoder 301 in the seventh embodiment according to the present invention.

The system shown in FIG. 14 comprises an MPEG-4 decoder 301, a display signal converter 302, a change region detector 303 and a difference signal detector 304. In this system, the MPEG-4 decoder 301 consists of a DMUX 101, a texture information decoder 102 and a shape signal decoder 103. The texture information decoder 102 comprises an inverse quantizer IQ, an inverse orthogonal transform section IDCT, a frame memory FM, a motion compensation predictive section MC and an adder.

If multiplexed data 310 is input to the MPEG-4 decoder 301, DMUX 101 demultiplexes the data 110 to demultiplex a texture information decode series 112 in a compression-coded state, the information on the position of the rectangular Bounding-Box containing VOP and the object shape information 113. The shape information decoder 103 decodes the information on the position of the rectangular Bounding-Box containing the object and the object shape information 113 from the VOP (object).

Using the information, the change region detector 303 detects a region combining the shape of the "previous frame" and that of the "current frame" as a change region if the position of the Bounding-Box and the shape thereof are changed between the "previous frame" and the "current frame", and thereby outputs the change region address information 314.

Further, the MPEG-4 decoder 301 supplies the texture information decoding series 112 demultiplexed by the DMUX 101 to the texture information decoder 102. Then, the texture information decoder 102 decodes the texture information 115 on the "current frame" using the texture information on the "previous frame" held in the frame memory FM.

That is to say, in the texture information decoder 102, the inverse quantizer IQ dequantizes the texture information decoding series 112 and the inverse orthogonal transform section IDCT conducts inverse orthogonal transform to the dequantized output based on an alpha map (shape information), adds the inverse orthogonal transformed output to a motion compensation predictive signal supplied from the motion compensation predictive section MC, and outputs the addition result to the display signal converter 302.

The motion compensation predictive section MC includes a frame memory FC and functions to operate based on a local decoded signal supplied from the shape information decoder 103 and to store signals for an object region and those for a background region. In addition, the motion compensation predictive section MC predicts a motion compensation value from the stored pictures signals for the object region to thereby output the value as a predictive value, and predicts a motion compensation value from the stored picture signals for the background region to thereby output the value as a predictive value.

The display signal converter 302 converts the signals (for information on the "previous frame" and that on the "current frame") into display signals and supplies the display signals to the difference signal detector 304. The difference signal detector 304 obtains a change region difference signal from the display signal of the "previous frame" and that of the "current frame", outputs the difference signal together with the change region address information as crystal drive signals, supplies the crystal drive signals to the crystal display unit, to allow rewriting the picture for the portion corresponding to the change region and displaying the picture.

In this example as in the case of the first embodiment, the change region detecting method and the shape of the change region may be determined in units of pixels, units of blocks or in units of lines.

Figure 15:
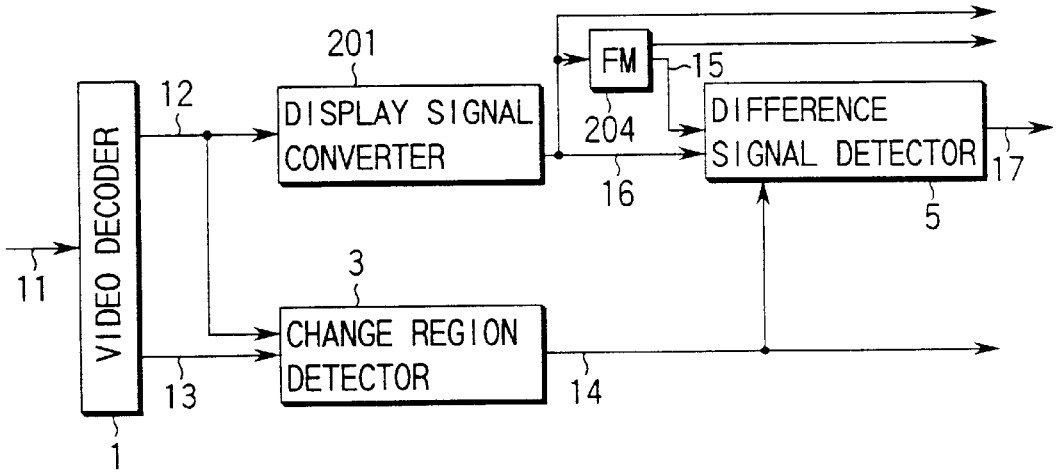
FIG. 15 is an explanatory view for an eighth embodiment according to the present invention.

With reference to FIG. 15, a system in the eighth embodiment will be described. This embodiment concerns a case where a frame memory FM 204 capable of storing the display signal of the "previous frame" is added to the configuration shown in FIG. 1. This system consists of a video decoder 1, a display signal converter 201, a change region detector 3 and a difference signal detector 4.

In this configuration, the display signal converter 201 converts only the decoded picture 13 of the "current frame" among the pictures decoded by the video decoder 1, into a display signal. The difference signal detector 4 reads the display signal 15 of the "previous frame" from the FM 204.

That is to say, in case of the configuration shown in FIG. 1, the display signal converter 2 converts the decoded picture 12 of the "previous frame" and the decoded picture 13 of the "current frame" among the pictures decoded by the video decoder 1 into display picture signals 15 and 16, respectively. In this embodiment, by contrast, the display signal converter 201 deals with only the decoded picture 12 of the "current frame" and converts it into a display signal.

The video decoder 1 decodes input video encoded data 11. The change region detector 3 obtains the difference between the decoded picture 12 of the "previous frame" and the decoded picture 13 of the "current frame" from among the pictures decoded by the video decoder 1, sets a region having the difference as a change region and detects a change region address 14.

Further, the display signal converter 201 converts the decoded picture 12 of the "previous frame" into a display picture signal 15, converts the decoded picture 13 of the "current frame" into a display picture signal 16 and supplies the display picture signals thus obtained to both the frame memory 204 and the difference signal detector 4. The display signal converter 201 also outputs the display picture signal 16 of the "current frame" to the display apparatus to thereby display the picture.

The difference signal detector 4 obtains and outputs difference information 17 on the change region indicated by the change region address information 14 output from the change region detector 3 using the display picture signal 15 of the "previous frame" held in the frame memory 204 and the display picture signal 16 of the "current frame" output from the display signal converter 2.

The present apparatus configured as stated above can select a normal display mode and a power saving display mode. In the normal display mode, the input video encoded data 11 is decoded by the video decoder 1 and the decoded signal 13, as the decoded picture of the "current frame", is converted into the display picture signal 16. The display picture signal 16 is transmitted to the crystal display unit.

The display picture signal 16 is supplied to the crystal display unit as a crystal drive signal. The crystal display unit generates scanning signals necessary for normal scan to thereby conduct normal scan and, at the same time, generates a signal serving as a gradation corresponding to the display picture signal 16 to thereby display the picture.

In case of using the power saving mode of the system of the present invention for displaying the picture by rewriting the picture only in the change region, the input video encoded data 11 is decoded by the video decoder 1. The decoded signals are supplied to both the display signal converter 201 and the change region detector 3.

The change region detector 3 obtains the difference between the decoded picture 12 of the "previous frame" and the decoded picture 13 of the "current frame" among the decoded pictures decoded by the video decoder 1 and detects a region having the difference. Setting the region having the difference as a change region, the change region detector 3 detects the address 14 of the change region.

The display signal converter 201 converts the decoded picture 13 of the "current frame" into the display picture signal 16 and outputs the signal 16. The display picture signal 16 is held in the frame memory 204 and also supplied to the difference signal detector 4.

The difference signal detector 4 is also supplied with a display picture signal held in the frame memory 204 and read therefrom. This display picture signal is not the display picture of the "current frame" but a display picture signal 15 of a one-frame previous frame.

The difference signal detector 4 obtains difference information 17 on the change region indicated by the change region address 14 using the display picture signal 15 of the "previous frame" and the display picture signal 16 of the "current frame", sets the change region address 14 and the difference information 17 as crystal drive signals and supplies the drive signals to the crystal display unit to thereby display the picture.

The crystal drive signals controls signals such that the picture of the crystal display unit is rewritten in units of pixels or in units of pixel groups for lines containing the change region or for unit blocks containing the change region among the picture in units of blocks and that no picture signals are supplied to unchanged lines or unchanged unit blocks to thereby maintain the state of the previous picture. As a result, it is possible to minimize rewrite operation and to minimize the display-drive operation of the crystal display panel.

If the crystal display unit is configured to be capable of holding and reading the display signal of the "previous frame" as if it were an RAM, the change region detector 3 may set a region after movement from the change region between the "previous frame" and the "current frame" as a change region and sets the difference signal between the "previous frame" and the "current frame" as a crystal drive signal.

Meanwhile, a battery or batteries are mainly used as a power supply for a portable terminal. Despite its capacity, the battery is relatively heavy and occupies a large space. For these reasons, it is important to realize power saving for the portable terminal. To do so, consideration will be given to a display technique intended to save the power of the crystal display serving as a key part of the portable terminal.

In the ninth embodiment described hereinafter, a change region of a video signal which has been compression-encoded according to the MPEG-4 method is displayed with fewer bits than normal bits, thereby reducing power consumption.

In this ninth embodiment, it is determined whether a macro block is a "motion macro block" or a "still macro block". If it is a "motion macro block", that is, the block is in motion, the picture is display-driven by lowering the display gradation of the macro block or reducing the number of display colors therefore, thereby realizing low power consumption operation. The detailed description of this embodiment will be given hereinafter.

Figure 16:
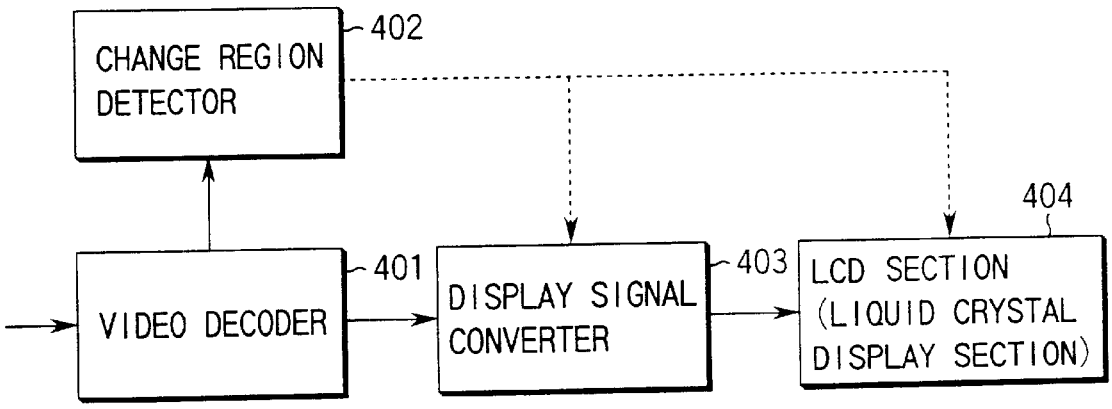
FIG. 16 is an explanatory view for a ninth embodiment according to the present invention.

FIG. 16 is a block diagram showing the configuration of a video display apparatus in the ninth embodiment. The change region of the video signal is displayed with fewer bits than normal bits to thereby allow the apparatus to operate with low power consumption.

The liquid crystal display apparatus shown in FIG. 16 comprises a video decoder 401, a change region detector 402, a display signal converter 403 and an LCD section 404. The video decoder 401 decodes decoding data on an input video picture. The change region detector 402 determines a change region on a picture plane based on information from the video decoder 401. Namely, the change region detector 402 obtains the difference between the decoded picture of a "previous frame" and that of a "current frame" among the pictures decoded by the video decoder 401, detects a region having the difference as a change region and outputs address information on the detected change region.

The display signal converter 403 performs processing to make the number of display bits for the change region on the picture plane lower than that of the normal bits based on the determination result of the change region detector 402 and the address information on the change region. The LCD section 404 is a display for displaying picture signals by means of liquid crystal. The LCD section 404 displays a picture on required pixel positions based on the picture signals generated by the display signal converter 403. The LCD section or display 404 is drive-controlled to display the change region with fewer bits than the normal bits to thereby reduce power consumption. The LCD section 404 corresponds to the crystal display unit configured shown in, for example, FIGS. 3, 5, 7 or 11.

In the present system configured as stated above, the decoding data received from a transmission path or a storage system is decoded by the video decoder 401 and fed to the display signal converter 403. The change region detector 402 determines the change region on the picture plane based on the information from the video decoder 401. The determination of the change region is made in units of blocks, lines or pixels.

The display signal converter 403 set the number of display bits for the change region on the picture plane lower than that of the normal bits. The picture signals generated by the display signal converter 403 are transmitted to the LCD section 404. The change region is displayed with fewer bits than the normal bits to thereby reduce power consumption. The color picture signals generated by the display signal converter 403 may be either RGB signals or YUV signals.

In this embodiment, the change region is displayed with fewer bits than the normal bits. To this end, the change region is displayed by means of, for example, the dither scheme. As for an unchanged region of the picture, the number of bits of the picture signals is not changed and the region is displayed by means of the normal gradation display method. Namely, because of the changes of the picture change region, small information thereon cannot be visually recognized by human eyes. Using this, the change region is displayed with lower resolution. The unchanged region is displayed as usual.

In other words, as already stated in the third embodiment, the unchanged region is displayed by the normal gradation display method and the change region is displayed by the dither scheme. By doing so, it is possible to lower spatial resolution and to reduce the number of gradations to be used.

If so, the original gradation is regenerated between two or more adjacent pixels. As for a picture displayed with, for example, gradations of eight bits, upper-four-bit gradation display is carried out for each pixel. That is, the picture is displayed with an intermediate gradation between the two pixels by the combination of gradations.

Alternatively, by reducing the number of intermediate gradations in the change region, the picture can be displayed with, for example, upper-six-bit gradations. Whichever means, it is necessary to avoid greatly deteriorating picture quality.

As can be seen, in this embodiment, the number of display bits for the pixels or groups of a plurality of pixels of the current frame which belong to the change region or is set lower than that of the display bits for the pixels or groups of pixels of the current frame which do not belong to the change region.

As for the change region or particularly the continuously change region of a picture, it is difficult for human eyes to perceive the resolution of the region due to the human biological properties. Utilizing this, the number of display bits for the picture in a moving region is reduced and the resolution thereof is lowered. If resolution is lowered, time required for writing is reduced and the picture is rewritten only in the change region. Therefore, it is possible to rewrite the change region within a one-frame time and there is less fear of deteriorating apparent display quality. Moreover, by lowering the resolution, driving power can be reduced eventually.

Next, in case of the "motion macro block", the picture is displayed with fewer gradations or fewer colors, thereby realizing low power consumption operation, which will be described as a concrete example 2 of the ninth embodiment hereinafter.

Figure 17:
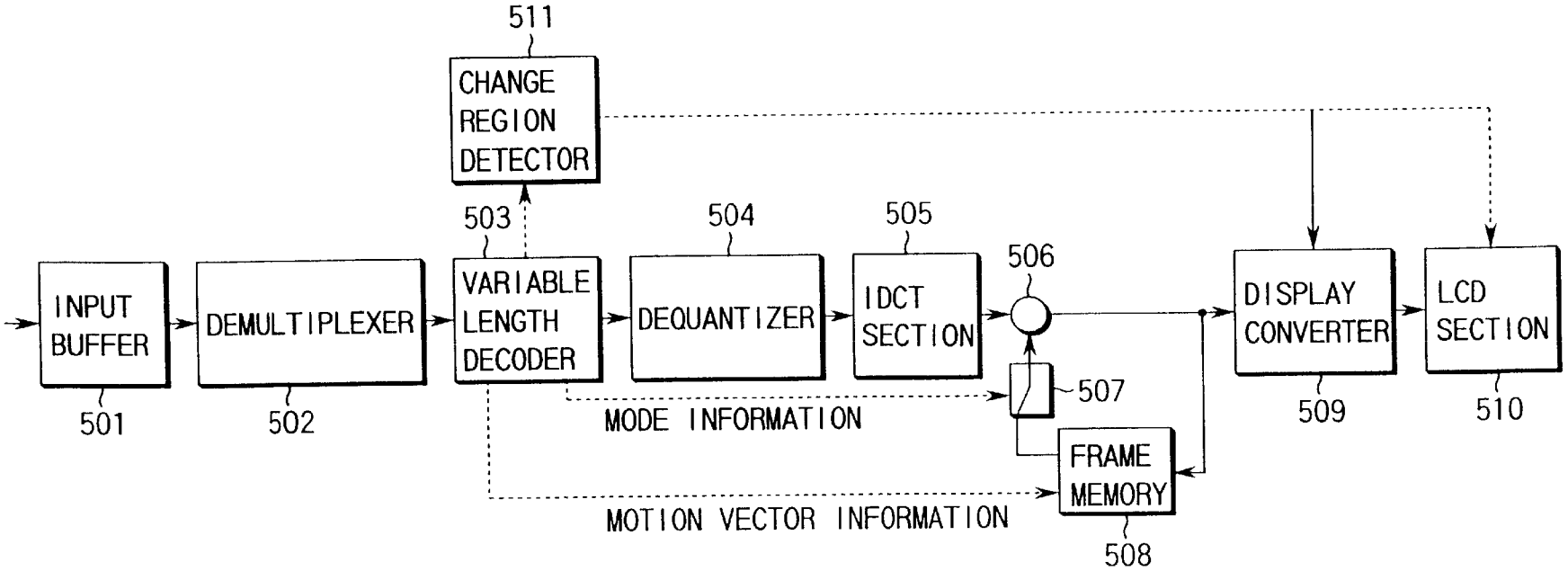
FIG. 17 is an explanatory view for the ninth embodiment according to the present invention.

FIG. 17 is a block diagram showing the configuration of a video picture display apparatus as a concrete example 2 of the ninth embodiment.

This video picture display apparatus comprises an input buffer 501, a demultiplexer 502, a variable length decoder 503, a dequantizer section 504, an inverse orthogonal transform (IDCT) section 505, an adder 506, a mode switch 507, a frame memory 508, a display signal converter 509 and an LCD section 510.

Among these constituent elements, the input buffer 501, the demultiplexer 502, the variable length decoder 503, the dequantizer section 504, the IDCT section 506, the adder 507, the mode switch 507 and the frame memory 508 constitute a video decoder as a whole.

The input buffer 501 temporarily stores received encoded data. The demultiplexer 502 demultiplexes the encoded data supplied through this input buffer 501 for each frame based on syntax. The variable length decoder section 503 decodes the variable length code of each syntax information based on the outputs of the demultiplexer 502.

The dequantizer 504 dequantizes the quantized DCT coefficient information decoded by the variable length decoder 503. The IDCT (inverse orthogonal transform) section 505 conducts inverse discrete cosine transform to the output of the variable length decoder 503, thereby generating a reconstructed picture signal.

The adder 506 can receive data from the frame memory 508 if the mode switch 507 is turned on. This adder 506 adds together the data subjected to inverse discrete cosine transform by the IDCT section 505 and motion compensated data on a reference picture compensated by the frame memory 508, and generates a reconstructed picture signal. This reconstructed picture signal is stored as a reference picture in the frame memory 508 and also input to the display signal converter 509.

The mode switch 507 is to switch a path connecting the output of the frame memory 508 to the adder 506 and on/off-controls the path according to the mode of the macro block decoded by the variable length decoder 503.

For example, the mode switch 507 is turned off if the mode information output from the variable length decoder 503 is "NOT CODED". Then, the adder 506 makes a motion compensation using the picture held in the frame memory 508 as a reference picture and generates a reconstructed picture signal. This reconstructed picture signal is stored in the frame memory 508 as a reference picture and also input to the display signal converter 509.

The mode switch 507 is turned off if the mode of the macro block is "INTRA" in the variable length decoder 503, to thereby prohibit signals from being read from the frame memory 508. In this state, in the video decoder, the quantized DCT coefficient information decoded by the variable length decoder 503 is dequantized by the dequantizer 504, the output of the dequantizer 504 is subjected to inverse discrete cosine transform by the IDCT section 505 to be thereby reconstructed as a reconstructed picture signal.

This reconstructed picture signal is stored in the frame memory 508 as a reference picture and also input to the display signal converter 509.

The mode switch 507 is turned on if the mode of the macro block is "INTER" in the variable length decoder 503, to thereby permit signals to be read from the frame memory 508. In this state, in the video decoder, the quantized DCT coefficient information decoded by the variable length decoder 503 is dequantized by the dequantizer 504 and the output of the dequantizer 504 is subjected to inverse discrete cosine transform by the IDCT section 505. Then, the adder 506 adds conversion coefficient information to the picture information obtained by motion-compensating for the reference picture in the frame memory 508 based on a motion vector decoded by the variable length decoder 503, and generates a reconstructed picture signal. This reconstructed picture signal is stored in the frame memory 508 as a reference picture and also input to the display signal converter 509.

The display signal converter 509 converts the reconstructed picture signal into a display picture signal. The LCD section 510 displays a picture using this display picture signal and corresponds to the crystal display unit configured as shown in, for example, FIGS. 3, 5, 7 or 11.

The change region detector 511 functions to determine whether a target macro block supplied to the display signal converter 509 as a reconstructed picture signal is a "motion macro block" or a "still macro block" based on the output of the variable length decoder 503 and to inform the display signal converter 509 of the determination result.

In response to the determination result, if the macro block is a "motion macro block", that is, if the macro block is in motion, the display signal converter 509 functions to convert the display signal into a display picture signal with lowered display gradation or fewer display colors for the macro block and to supply the resultant display picture signal to the LCD section (crystal display unit) 510.

In the present system configured as stated above, the encoded data received from the transmission path or the storage system is temporarily stored in the input buffer 501 and demultiplexed for each frame by the demultiplexer 502 based on syntax and output to the variable length decoder 503. The variable length decoder 503 decodes the variable length code of each syntax information and the macro block, and also determines the mode of the macro block.

The variable length decoder 503 turns off the mode switch 507 if the mode of the macro block is "INTRA". As a result, in the video decoder, the quantized DCT coefficient information on the macro block decoded by the variable length decoder 503 is dequantized by the dequantizer 504 and subjected to inverse discrete cosine transform by the IDCT section 505, to thereby generate a reconstructed picture signal. The reconstructed picture signal is output to the display signal converter 509. The reconstructed picture signal is also stored in the frame memory 508 as a reference picture.

The mode switch 507 is turned on if the mode of the macro block is "INTER" in the variable length decoder 503. As a result, in the video decoder, the quantized DCT coefficient information on the macro block decoded by the variable length decoder 503 is dequantized by the dequantizer 504, subjected to inverse discrete cosine transform by the IDCT section 505 and then supplied to the adder 506. Further, based on the motion vector decoded by the variable length decoder 503, the picture information obtained by motion-compensating for the reference picture in the frame memory 508 is supplied to the adder 506. Consequently, the adder 506 adds together the conversion coefficient information and the picture information and generates a reconstructed picture signal.

This reconstructed picture signal is stored in the frame memory 508 as a reference picture and also input to the display signal converter 509.

Moreover, the video decoder turns off the mode switch 507 if the mode of the macro block obtained in the variable length decoder 503 which is one of the constituent elements of the video decoder, is "NOT_CODED". In this mode, in the video decoder, the reference picture in the frame memory 508 is motion-compensated and a reconstructed picture signal is generated. This reconstructed picture signal is stored in the frame memory 508 as a reference picture and also input to the display signal converter 509.

The change region detector 511 determines whether the target macro block supplied to the display signal converter 509 as a reconstructed picture signal is a "motion macro block" or a "still macro block" based on the output of the variable length decoder 503 and informs the display signal converter 509 of the determination result. In response to the determination result, if the target macro block is a "motion macro block", i.e., the target macro block is in motion, the display signal converter 509 converts the display picture signal into a display picture signal with lowered display gradation or fewer display colors for the macro block. If the target macro block is a "still macro block", i.e., the target macro block has no change, the display signal converter 509 converts the display picture signal into a display picture signal with standard display gradation or standard display colors for the macro block and supplies the display picture signal to the LCD section 510, to allow displaying the picture based on the display picture signal.

In this way, it is determined whether a target macro block is a "motion macro block" or a "still macro block". If the target macro block is a "motion macro block", i.e., the target macro block is in motion, the picture is displayed with lowered display gradation or fewer display colors for the macro block, thereby making it possible to realize low power consumption operation.

Namely, as for the change region or particularly the continuously change region in a picture, it is difficult for human eyes to perceive the resolution and subtle color change of the region due to the human biological properties. Utilizing this, the number of display bits for the picture in a moving region is reduced and the resolution thereof is lowered. If resolution is lowered, time required for writing is reduced and the picture is rewritten only in the change region. Therefore, it is possible to rewrite the picture in the change region within a one-frame time and there is less fear of deteriorating apparent display quality. Moreover, by lowering the resolution, driving power can be reduced. This makes it possible to maintain picture quality and to provide a crystal display unit capable of reducing power for driving the LCD.

Figure 18:
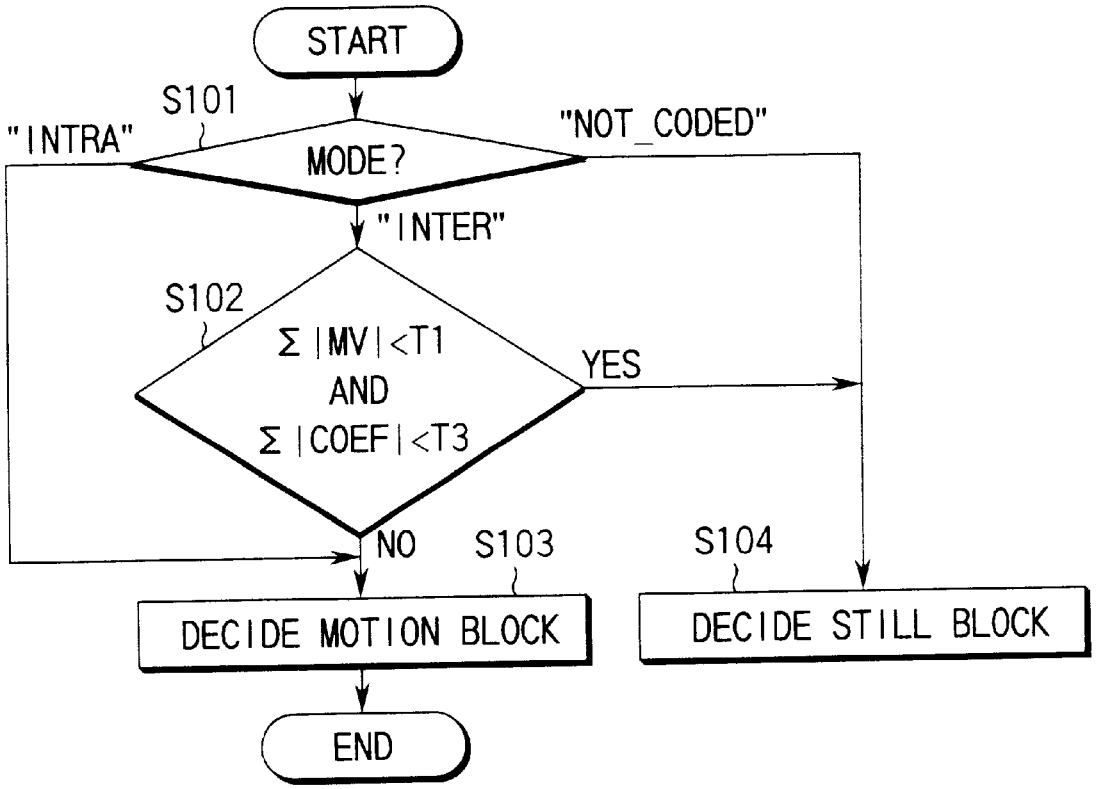
FIG. 18 is an explanatory view for the ninth embodiment according to the present invention.

FIG. 18 is a flow chart showing an example of the operation of the change region detector 511.

In the change region detector 511, every macro block to be processed is classified as a "still macro block" or a "motion macro block" (in step S101).

First, if the mode information decoded by the variable length decoder 503 is "NOT_CODED", the input macro block is determined as a "still macro block" (in step S104). If the mode information indicates an "INTRA" coding mode, the input macro block is determined as a "motion macro block" (in step S103).

If the mode information indicates an "INTER" coding mode, the absolute sum Σ|MV | of the motion vectors of the macro block is less than a threshold value T1 and the absolute sum Σ|COEF | of the DCT coefficient of the macro block is less than a threshold value T2, then the input macro block is determined as a "still macro block" (in steps S102 and S104). Otherwise, the input macro block is determined as a "motion macro block" (in steps S102 and S103). It is noted that a mode using the reference pixel in the frame is the "INTRA" coding mode and a mode referring to the motion compensation predictive signal is the "INTER" coding mode.

As shown in FIG. 2B, the above-stated "motion macro block" is assumed as a change region. These determination results are fed to both the display signal converter 509 and the LCD section 510.

Alternatively, the change region detector 511 may make the following determination for each line. That is, the macro block lines on which the "motion macro block" is present may be determined as a change region as a whole.

The display signal converter 509 coverts a reconstructed YUV picture signal into an RGB picture signal. One example for converting a YUV signal into an RGB signal is shown below (Formula):

$$\begin{vmatrix} R \\ G \\ B \end{vmatrix} = \begin{vmatrix} 1.0000 & 0.0000 & 1.4020 \\ 1.0000 & -0.3441 & -0.7141 \\ 1.0000 & 1.7720 & 0.0000 \end{vmatrix} \begin{vmatrix} Y \\ U \\ V \end{vmatrix}$$

Here, at the output stage of the video decoder, offset values (128) are added to U and V signals. Due to this, it is necessary to subtract 128 from the U and v signals, respectively, prior to the calculation of Formula 1.

As for the motion macro block, the signals are quantized in accordance with the following formula and converted to data of "1"to "7" bits.

$$R'=R/2^{8-n}$$

$$G'=G/2^{8-n}$$

$$B'=B/2^{8-n}$$

$$1 \leqq n \leqq 7.$$

As for the "still macro block", a RGB signal of eight bits is transmitted to the LCD section 510. AS for the "motion macro block", an R'G'B' signal of upper n bits (1≦n≦7) is transmitted to the LCD section 510.

The display signal converter 509 outputs the reconstructed YUV picture signal as it is, quantizes the signal for the "motion macro block" by the next Formula 3, converts and outputs the bock into data (Y'U'V') of "1" to "7" bits.

$$Y'=Y/2^{8-n}$$

$$U'=U/2^{8-n}$$

$$V'=V/2^{8-n}$$

$$1 \leqq n \leqq 7.$$

In this case, the "still macro block" is transmitted as a YUV signal of eight bits to the LCD section 510 and the "motion macro block" is transmitted as a Y'U'V' signal of upper grade n bits (1 ≦n≦7).

Figure 19:
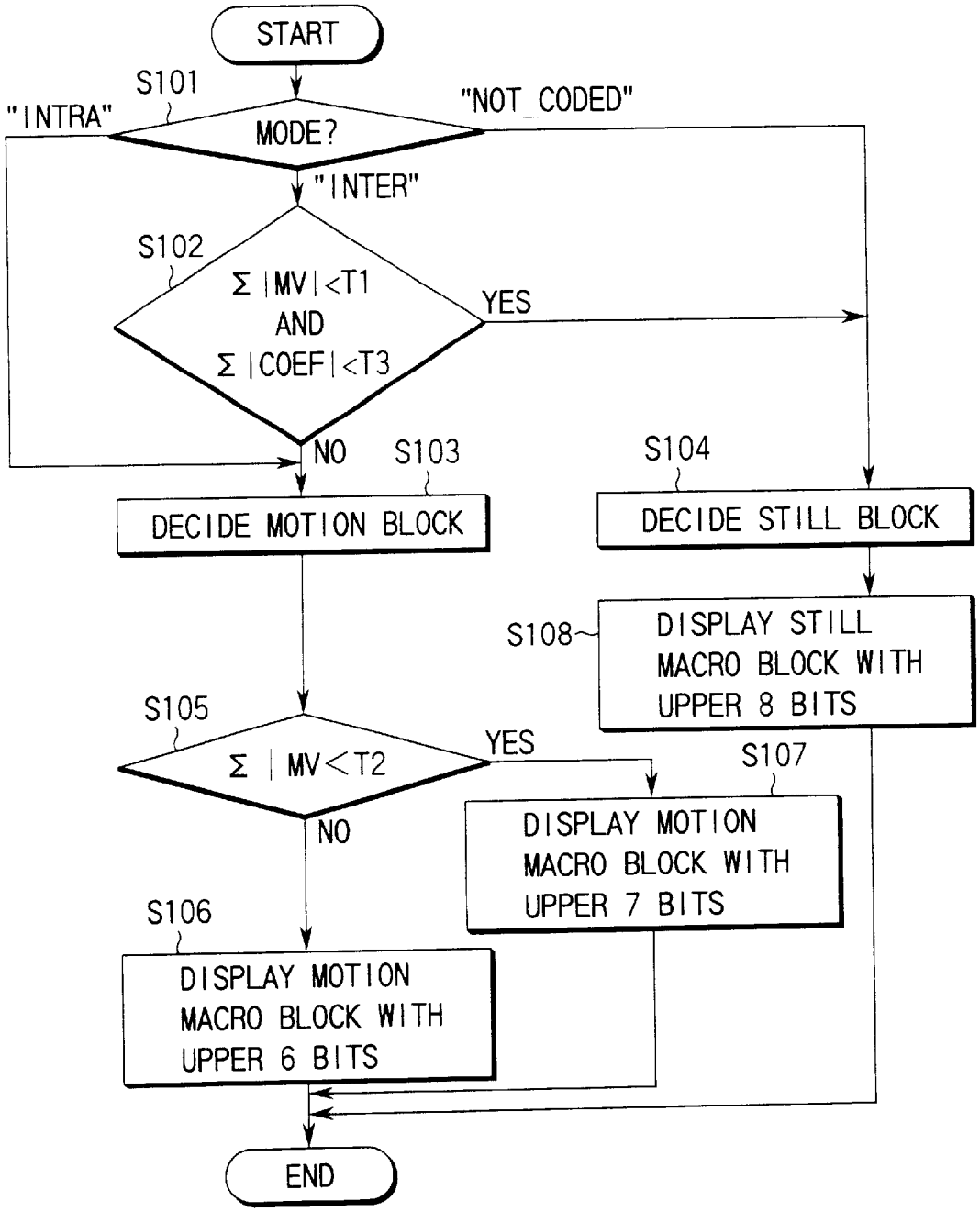
FIG. 19 is an explanatory view for the ninth embodiment according to the present invention.

The number of display gradations for the "motion macro block" can be changed according to the magnitude of the absolute sum Σ|MV| of motion vectors of the macro block. For example, the processing shown in FIG. 18 is slightly modified to that shown in FIG. 19. As shown in FIG. 19, threshold values T1 and T2 are set (T1<T2). If the absolute sum is less than T1, eight bits are used to display the "still macro block" (in steps S102, S104 and S108). If not less than T1 and less than T2, upper six bits are used to display the "motion macro block" (in steps S102, S103, S105 and S107). If not less than T2, upper six bits are used to display the "motion macro block" (in steps S102, S103, S105 and S106). In this way, the number of gradations can be changed according to the motion amount of the macro block.

Likewise, the number of gradations can be changed according to the magnitude of the absolute sum "Σ|COEF|" of the DCT coefficients of the macro block. For example, threshold values T3 and T4 are set (T3<T4). If the absolute sum is less than T3, eight bits are used. If the absolute sum is not less than T3 and less than T4, upper seven bits are used. If not less than T4, upper six bits are used. In this way, the number of gradations is changed according to the change amount of the display picture.

The LCD section 510 displays a picture with fewer colors if a macro block supplied from the change region detector 511 is a "motion macro block" from the picture signal from the display signal converter 509 and the determination result as to whether each macro block is a motion or still macro block, thereby realizing low power consumption operation.

The change region detector 511 in the above concrete example may be replaced by the change region detector 3 in the first embodiment. Also, the video decoder 401 and the change region detector 402 may be replaced by the MPEG-4 decoder 301 and the change region detector 303 in the first embodiment, respectively.

As can be seen from the above, it is determined whether a macro block is a "motion macro block" or a "still macro block". If the macro block is a "motion macro block", that is, the macro block is in motion, then the picture is displayed with lowered display gradation or fewer display colors for the macro block, thereby making it possible to realize low power consumption operation.

As stated so far in detail, the present invention can provide a liquid crystal display apparatus characterized as follows. Using video decoding information, reset-driving, long-time-driving and emphasis-driving are adaptively conducted. As a result, the display quality visually recognized and perceived by a user can be improved and picture quality can be improved, accordingly. Further, using the video decoding information, the number of display bits for a specific region on the picture plane is adaptively reduced. As a result, it is possible to reduce power for driving the LCD without deteriorating subjective display quality.

In case of displaying a video picture, the conventional liquid crystal display apparatus re-inputs picture signals to all pixels, irrespectively of the presence/absence of a picture change between frames or between fields. It follows that picture signals are written even to the pixels which have no picture change and do not need rewrite operation and that power is consumed accordingly. The present invention, by contrast, conducts write operation to pixels corresponding to a change region and not to pixels corresponding to an unchanged region, thereby making it possible to reduce power consumption.

Furthermore, in the MPEG-4 method, address information on the change region and difference information on the picture are utilized. Due to this, picture signal transmission amount can be reduced. Besides, because of the reduced picture signal transmission amount, the liquid crystal display apparatus can also reduce power consumption. Hence, the present invention can generate a picture signal from the address signal and the difference signal and reduce power consumption.

Moreover, the present invention can further improve picture quality by conducting reset-driving, long-time-driving and emphasis-driving in writing picture signals to the pixels in the change region.

Additionally, the present invention can reduce write signals transmitted to the display apparatus and reduce power consumption, by using picture signals with the number of bits for gradation levels reduced to be written to the change region or particularly to large change region.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An active matrix type display apparatus comprising:

an active matrix type display panel having a plurality of pixels arranged in a matrix, signals lines for inputting a video signal to the plurality of pixels, and switching elements configured to select the plurality of pixels individually;

a video decoder configured to decode an input compressed video data and obtain a reconstructed picture signal for each picture;

a change region detector configured to detect a change region between a previous picture and a current picture by using the reconstructed picture signal obtained by the video decoder, and obtain address data on the change region;

a display signal converter configured to input the reconstructed picture signal, and convert the reconstructed picture signal into a display picture signal;

a difference signal detector configured to input a display picture signal of the previous picture and a display picture of the current picture, and detect a difference signal indicating at least a difference between the previous picture and the current picture;

a switch driver configured to selectively drive the switching elements and select the pixels corresponding to the change region in accordance with the address data obtained by the change region detector; and a signal line driver configured to add the difference signal obtained by the difference signal detector and the display picture signal of the previous picture, and input an addition result to the signal lines.

2. An active matrix type display apparatus according to claim 1, wherein the display panel includes a plurality of memory elements interposed between the switching elements and the pixels, respectively, and holding the video signal.

3. An active matrix type display apparatus according to claim 1, wherein the display panel includes row address lines and column address lines; the switch driver comprises a row address line drive circuit configured to drive the row address lines and a column address line drive circuit for driving the column address lines; and the row address line drive circuit and the column address line drive circuit include rewrite sections configured to supply drive signals to the row address lines and the column address lines in accordance with the address data indicating the change region and for rewriting the pixels in the change region, respectively.

4. An active matrix type display apparatus according to claim 3, wherein the rewrite sections conduct rewrite operation in units of blocks of N×N pixels corresponding to the change region.

5. An active matrix type display apparatus according to claim 4, wherein the rewrite sections rewrite blocks belonging to a change region having a large change amount of the difference signal prior to rewriting other blocks.

6. An active matrix type display apparatus according to claim 3, wherein the rewrite sections rewrite the pixels corresponding to the change region in units of lines.

7. An active matrix type display apparatus according to claim 1, wherein the switch driver includes a rewrite section configured to rewrite a portion having a large change region prior to rewriting a portion having a small change region when rewriting the video for unit blocks containing the change region in units of pixels.

8. An active matrix type display apparatus according to claim 1, wherein the signal line driver includes a signal processing unit configured to conduct video processing so as to display the pixels belonging to the change region and the pixels which do not belong to the change region by different gradation display methods.

9. An active matrix type display apparatus according to claim 8, wherein the pixels which do not belong to the change region are subjected to video-processing to be displayed by the gradation display method, and the pixels belonging to the change region are subjected to video-processing to be displayed by a dither scheme.

10. An active matrix type display apparatus according to claim 1, wherein the switch driver selectively drives the switching elements for inputting the video signal reflecting on change into the pixels belonging to the change region, and for holding the previous picture for the pixels which do not belong to the change region.

11. An active matrix type display apparatus according to claim 1, further comprising a setting section configured to set a write time for the pixels belonging to the change region longer than a write time for the pixels which do not belong to the change region.

12. An active matrix type display apparatus according to claim 1, wherein the display panel comprises a liquid crystal display panel containing a liquid crystal material; and the driver selectively drives the switching elements for inputting the video signal having a signal amplitude including response characteristics of the liquid crystal material into the pixels belonging to the change region and for holding the previous picture for the pixels which do not belong to the change region.

13. An active matrix type display apparatus according to claim 1, wherein the change region detector is a detector configured to detect a change region on a picture plane from the difference signal indicating a difference between a reconstructed picture of the previous picture and a reconstructed picture of the current picture.

14. An active matrix type display apparatus according to claim 1, wherein the change region detector includes a detecting section configured to detect the change region on a picture plane by using at least one of a coding mode, a conversion coefficient and a magnitude of a motion vector among decoding results of the video decoder.

15. An active matrix type display apparatus according to claim 1, wherein the video decoder is a decoder having an MPEG-4 compression encoding system; and the change region detector inputs shape information reproduced by the decoder, and detects the change region.

16. An active matrix type display apparatus comprising:

an active matrix type display panel having a plurality of pixels arranged in a matrix, signals lines for inputting a video signal to the plurality of pixels, and switching elements configured to select the plurality of pixels individually;

a video decoder configured to decode an input compressed video data and obtain a reconstructed picture signal for each picture;

a change region detector configured to detect a change region between a previous picture and a current picture by using the reconstructed picture signal obtained by the video decoder, and obtain address data on the change region;

a display signal converter configured to input a reconstructed picture signal of the previous picture and a reconstructed picture signal of the current picture signal, and convert the reconstructed picture signals into display pixel signals having different amounts of display data between the pixels belonging to the change region and the pixels which do not belong to the change region, respectively;

a difference signal detector configured to input a display picture signal of the previous picture and a display picture of the current picture, and detect a difference signal indicating at least a difference between the previous picture and the current picture;

a switch driver configured to selectively drive the switching elements and select the pixels corresponding to the change region in accordance with the address data obtained by the change region detector; and a signal line driver configured to add the difference signal obtained by the difference signal detector and the display picture signal of the previous picture, and input an addition result to the signal lines.

17. An active matrix type display apparatus according to claim 16, wherein the display panel includes a plurality of memory elements interposed between the switching elements and the pixels, respectively, and holding the video signal.

18. An active matrix type display apparatus according to claim 16, wherein the switch driver selectively drives the switching elements for inputting the video signal reflecting on change into the pixels belonging to the change region, and for holding the previous picture for the pixels which do not belong to the change region.

19. An active matrix type display apparatus according to claim 16, further comprising a setting section configured to set a write time for the pixels belonging to the change region longer than a write time for the pixels which do not belong to the change region.

20. An active matrix type display apparatus according to claim 16, wherein the display panel comprises a liquid crystal display panel containing a liquid crystal material; and the switch driver selectively drives the switching elements for inputting the video signal having a signal amplitude including response characteristics of the liquid crystal material into the pixels belonging to the change region and for holding the previous picture for the pixels which do not belong to the change region.

21. An active matrix type display apparatus according to claim 16, wherein the change region detector is a detector configured to detect a change region on a picture plane from the difference signal indicating a difference between a reconstructed picture of the previous picture and a reconstructed picture of the current picture.

22. An active matrix type display apparatus according to claim 16, wherein the change region detector includes a detecting section configured to detect the change region on a picture plane by using at least one of a coding mode, a conversion coefficient and a magnitude of a motion vector among decoding results of the video decoder.

23. An active matrix type display apparatus according to claim 16, wherein the video decoder is a decoder having an MPEG-4 compression encoding system; and the change region detector inputs shape information reproduced by the decoder, and detects the change region.

24. A liquid crystal display apparatus comprising:

a liquid crystal panel having a plurality of pixels arranged in a matrix, signals lines for inputting a video signal to the plurality of pixels, and switching elements configured to select the plurality of pixels individually;

a video decoder configured to decode an input compressed video data and obtain a reconstructed picture signal for each frame;

a change region detector configured to detect a change region between a previous frame and a current frame by using the reconstructed picture signal obtained by the video decoder, and obtain address data on the change region;

a display signal converter configured to input a reconstructed picture signal of the previous frame and a reconstructed picture signal of the current frame, and convert the reconstructed picture signals into display picture signals, respectively;

a switch driver configured to selectively drive the switching elements in accordance with an address signal obtained by the change region detector; and a signal line driver configured to add the difference signal obtained by the difference signal detector and the display picture signal of the previous frame, obtain a display picture signal having display bits for the pixels belonging to the change region of the current frame set fewer than display bits for the pixels belonging to other regions, and input the display picture signal to the signal lines.

25. A liquid crystal display apparatus according to claim 24, wherein the change region detector includes a detecting section configured to detect a change region on a picture plane from the difference signal indicating a difference between a reconstructed picture of the previous frame and a reconstructed picture of the current frame.

26. A liquid crystal display apparatus according to claim 24, wherein the change region detector includes a detecting section configured to detect the change region on a picture plane by using at least one of a coding mode, a conversion coefficient and a magnitude of a motion vector among decoding results of the video decoder.

27. A liquid crystal display apparatus according to claim 24, wherein the video decoder is constructed by an MPEG-4 decoder; and the change region detector includes a detecting section configured to input shape information reproduced by the video decoder and detect a region in which the reconstructed signal of the previous frame and the reconstructed signal of the current frame have changed.

* * * * *

UNITED STATES PATENT AND TRADEMARK OFFICE

CERTIFICATE OF CORRECTION

PATENT NO. : 6,452,579 B1
DATED : September 17, 2002
INVENTOR(S) : Itoh et al.

It is certified that error appears in the above-identified patent and that said Letters Patent is hereby corrected as shown below:

Title page,
Item [57], ABSTRACT,
Lines 2-3, change “signals lines” to -- signal lines --.

Column 29,
Line 34, change “signals lines” to -- signal lines --.

Column 31,
Line 12, change “signals lines” to -- signal lines --.

Column 32,
Line 20, change “signals lines” to -- signal lines --.

Signed and Sealed this

Eighth Day of April, 2003

JAMES E. ROGAN
*Director of the United States Patent and Trademark Office*